US007717383B2

(12) United States Patent
Russell

(10) Patent No.: US 7,717,383 B2
(45) Date of Patent: May 18, 2010

(54) ADJUSTABLE SUPPORT MECHANISM

(76) Inventor: Edwin Robin Russell, 5a Hibernia Rise, Sorrento, WA (AU) 6020

( * ) Notice: Subject to any disclaimer, the term of this patent is extended or adjusted under 35 U.S.C. 154(b) by 492 days.

(21) Appl. No.: 10/580,612

(22) PCT Filed: Nov. 22, 2004

(86) PCT No.: PCT/US2004/039148

§ 371 (c)(1),
(2), (4) Date: Mar. 27, 2007

(87) PCT Pub. No.: WO2005/052876

PCT Pub. Date: Jun. 9, 2005

(65) Prior Publication Data

US 2007/0257173 A1 Nov. 8, 2007

(30) Foreign Application Priority Data

Nov. 24, 2003 (AU) ..... 2003906462

(51) Int. Cl.
*E04G 3/00* (2006.01)

(52) U.S. Cl. ..... 248/280.11; 248/281.11; 108/138

(58) Field of Classification Search ..... 248/280.11, 248/281.11, 282.1, 279.1, 285.1, 286.1, 292.12, 248/284.1, 276.1, 274.1; 16/242, 245, 316, 16/354; 312/208.1, 223.3; 108/92, 96, 138, 108/50.02

See application file for complete search history.

(56) References Cited

U.S. PATENT DOCUMENTS

| | | | | |
|---|---|---|---|---|
| 5,292,097 | A | 3/1994 | Russell | |
| 5,363,089 | A * | 11/1994 | Goldenberg | 340/7.63 |
| 5,924,666 | A * | 7/1999 | Liu | 248/286.1 |
| 6,012,693 | A * | 1/2000 | Voeller et al. | 248/280.11 |
| 6,113,046 | A * | 9/2000 | Wang | 248/278.1 |
| 6,135,404 | A * | 10/2000 | Wisniewski et al. | 248/281.11 |
| 6,533,229 | B1 * | 3/2003 | Hung | 248/286.1 |
| 6,672,553 | B1 * | 1/2004 | Lin | 248/276.1 |
| 6,769,657 | B1 * | 8/2004 | Huang | 248/278.1 |
| 7,567,436 | B2 * | 7/2009 | Jeong | 16/221 |

FOREIGN PATENT DOCUMENTS

AU 65578/90 5/1991

OTHER PUBLICATIONS

International Search Report for PCT/US2004/039148 dated Aug. 24, 2005.

* cited by examiner

*Primary Examiner*—A. Joseph Wujciak, III

(57) ABSTRACT

An adjustable support mechanism is assembled from: a first bracket that can attach to the underside of a desk; a second bracket that can attach to a keyboard platform; a pivotally coupled connecting member; and a linking member. In one embodiment of the present invention, pivotal movement of the connecting member relative to the first bracket causes the linking member to move the second bracket in a corresponding manner.

19 Claims, 23 Drawing Sheets

ADJUSTABLE SUPPORT MECHANISM

CROSS-REFERENCE TO RELATED APPLICATIONS

This application claims the benefit of International Patent Application No. PCT/US2004/039148, filed Nov. 22, 2004, which claims the benefit of Australian Patent Application No. AU2003906642, filed Nov. 24, 2003, both of which are incorporated by reference herein in their entirety.

1. Field of the Invention

The present invention relates to Supports that facilitate adjustment of one bracket relative to another 2. Background to the Invention The need for a mechanism that enables the adjustment of the height of a keyboard support surface relative to a fixture is well recognized. My Australian Patent No. 65578/90 and my U.S. Pat. No. 5,292,097, disclose improved four-bar or four element parallelogram mechanisms that allow a support surface height to be adjusted relative to a fixed surface. These mechanisms were of a type which enabled a working platform to be attached to a moveable element or bracket, which in turn was pivotally connected to one end of a pair of substantially parallel link elements, which in turn were pivotally connected at their other end to a fixed element or bracket, which was capable of being affixed or otherwise mounted to the underside of a desk-top. A feature of these mechanisms was their ability to maintain a substantially parallel relationship between the moveable element or bracket and the fixed element or bracket throughout the height adjustment range.

In many four-bar linkage mechanisms, the amount of rotation of the moveable bracket relevant to the fixed bracket is limited by the overlapping and interference of the link arms. Also in many four-bar linkage mechanisms, the rotational movement of the moveable bracket relative to the fixed bracket may require protection guards to be positioned to avoid the creation of pinch points. Also in many adjustable support mechanisms, the linkage arms and brackets may intrude significantly into knee-hole space and otherwise interfere with the operator using the attached support platform.

It is to be understood that, if any prior art publication is referred to herein, such reference does not constitute an admission that the publication forms a part of the common general knowledge in the art in Australia or any other country.

The present invention attempts to overcome limitations of other platform support mechanisms.

BRIEF SUMMARY OF THE INVENTION

According to a first aspect of the present invention there is provided an adjustable support mechanism comprising:

a first bracket;

a second bracket;

a connecting member pivotally coupled to the first bracket at a first position and pivotally coupled to the second bracket at a second position spaced from the first position; and a linking member coupled to the connecting member so as to be movable in relation to the connecting member, wherein the linking member is arranged to engage the bracket: and the second bracket such that pivotal movement of the first bracket in a first rotational direction is related to movement of the linking member, which is in turn related to pivotal movement of the second bracket also in the first rotational direction.

According to a second aspect of the present invention there is provided an adjustable support mechanism comprising:

a. first bracket;

a second bracket;

a connecting member pivotally coupled to the first bracket at a. first position and pivotally coupled to the second bracket at a second position spaced from the first position; and a linking member coupled to the connecting member so as to be movable transversely in relation to a line between the first position and the second position, wherein the linking member is arranged to engage the first bracket such that pivotal movement of the first bracket in a first rotational direction is related to transverse movement of the linking member in a first transverse direction:

wherein the linking member is also arranged to engage the second bracket such that pivotal movement of the second bracket in the first rotational direction is also related to the transverse movement of the linking member in the first transverse direction. Preferably the first bracket comprises a planar member. Preferably the second bracket comprises a planar member. Preferably the first bracket is coupled to a first end of connecting member. Preferably the second bracket is coupled to a second end of connecting member. Preferably the linking member is coupled to the connecting member so as to be slidable in a direction perpendicular to the length of the connecting member, the length being parallel to the line between the first position and the second position.

Preferably the coupling arrangement between the connecting member and the linking member includes a transverse bar extending across the connecting member and a sleeve or spaced apart collars through which the transverse bar passes so as to guide the movement of the linking member relative to the connecting member.

Alternatively the coupling arrangement is in form of a sleeve at each end of the linking member through which an axle of each respective bracket passes, each sleeve being slidable along at least part of the length of each respective axle.

Preferably each bracket comprises a screw drive having an axis of rotation coinciding with axis of pivotal rotation of the bracket. Preferably the linking member comprises a follower for engaging the thread of each screw drive. Preferably the linking member and each bracket are each in a screwjack arrangement such that pivoting of each bracket with respect to connecting member causes rotation of the respective screw with respect to connecting member and linking member, which in turn causes transverse movement of the respective followers and thus in turn transverse movement of the linking member with respect to the connecting member. Preferably each follower is one of a pin, a rack a nut or a nut portion.

Typically the pitch of the screw of the first bracket is the same as the pitch of the screw of the second bracket, so that a change in angle between first bracket and connecting member is the same as the change in angle between second bracket and the connecting member.

Preferably the planar member of first bracket is parallel to the planar member of second bracket. Preferably the planar member of second bracket is parallel to planar member of first bracket through a range of movement of second bracket with respect to the first bracket.

In one embodiment the second bracket comprises an angle adjustment means so that the angle of the second bracket may be adjusted so that a support surface thereof is not parallel with the planar member of the first bracket.

Preferably the angle adjustment means comprises the follower being transversely movable and further comprises a shifter arranged to control the transverse position of the follower relative to the linking member.

Alternatively the angle adjustment means comprises the drive being transversely movable with respect to the connecting member; and further comprises a shifter arranged to control the transverse Position of the screw drive. Preferably the screw drive is also transversely slidable with respect to the planar member. Preferably the planar member is orbitally coupled to the screw drive.

Preferably the first bracket is arranged to be connectable to a stationery object, such as a bench or desk.

Preferably the supporting mechanism comprises a locking mechanism arranged to prevent transverse movement of the linking member with respect to connecting member when the locking mechanism activated, thereby locking the brackets in position relative to each other. Preferably the locking mechanism is in the form of an interference engaging region of the linking member being movable so as to engage an interference engaging region of the connecting member.

Alternatively the support mechanism comprises a locking mechanism arranged to prevent pivoting of one of brackets with respect to connecting member thereby locking the position of first bracket with respect to the second bracket when the locking mechanism is activated.

In a further alternative, the support mechanism comprises a locking mechanism arranged to bias the second bracket to attempt to orbitally rotate about the first bracket. or rotate the planar member of the second bracket so as to not be parallel with the planar member of the first bracket thereby locking the position of first bracket with respect to second bracket. Preferably the bias is the weight of the support mechanism under the influence of gravity when the planar member of the first bracket is horizontal.

Preferably the second bracket comprises a weight mounted distally from the pivotal coupling to the connecting member such that when the first bracket is substantially horizontal leverage of the weight with respect to connecting member acts as the locking bias.

Preferably pivotal movement of either bracket in relation to the connecting member in a second rotational direction, opposite to the first rotational direction, is related to transverse movement of the linking member is a second transverse direction, opposite the first traverse direction.

According to a third aspect of the present invention there is provided an adjustable support mechanism comprising:

a first bracket;

a second bracket;

a connecting member pivotally coupled to the first bracket at a first position and pivotally coupled to the second bracket at a second position spaced from the first position; and a linking member pivotally coupled to the connecting member so as to be pivotally about a point midway along a line between the first position and the second position, wherein the linking member is arranged to engage the first bracket such that pivotal movement of the first bracket in a first rotational direction is related to pivotal movement of the linking member in a first pivotal direction, wherein the linking member is also arranged to engage the second bracket such that pivotal movement of the second bracket in the first rotational direction is also related to the pivotal movement of the linking member in the first pivotal direction.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

DESCRIPTION OF DRAWING

In order to provide a better understanding, preferred embodiments of the present invention will now be described in greater detail, by way of example only, with reference to the accompanying drawings, in which:

FIG. 7A is a bottom view of an alternative arrangement of coupling the linking member 18 to the screw drive 34;

DETAILED DESCRIPTION OF PREFERRED EMBODIMENTS

Figure 1:
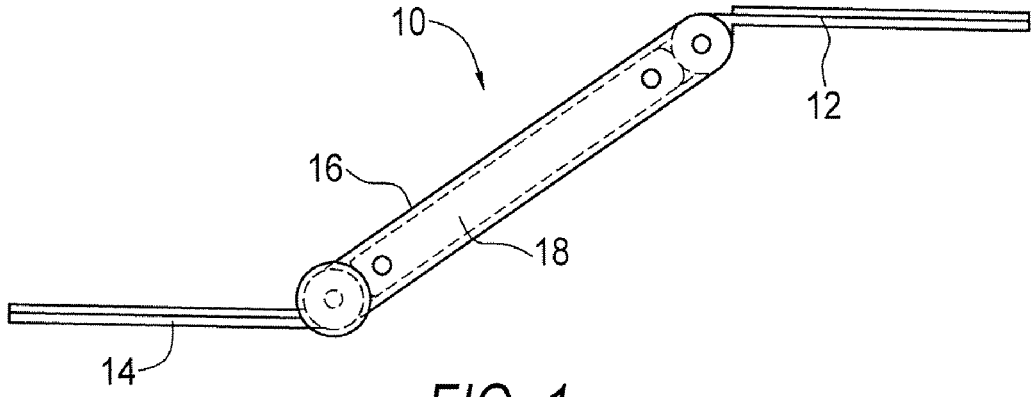
FIG. 1 is a side elevation of a preferring embodiment of an adjustable support mechanism according to the present invention.

Referring to FIG. 1 there was shown an adjustable support mechanism 10 which includes a first bracket 12 pivotally connected to a connecting member 16 which is in turn pivotally connected to a second bracket 14. A linking member 18 extends between axles of the brackets and is coupled to the connecting member so as to be transversely slidable with respect to the connecting member 16. The linking member 18 is coupled to each of the axles of the brackets 12 and 14 so that pivoting of the brackets 12 and 14 with respect to the connecting member causes transverse movement of the linking member 18.

Referring to FIGS. 2 to 5, in this embodiment the pivotal connections between the brackets 12 and 14 and the connecting member 16 are shown in more detail, as is the coupling between the brackets 12 and 14 and the linking member 18, as well as the coupling between the linking member 18 and the connecting member 16.

The bracket 12 includes a planar member 32 for fixing to a stationary object, such as a bench or desk, and a screw drive 34. The bracket 14 includes a planar member 32 for fixing to a movable object, such as a keyboard support platform, and a screw drive 34. The pivotal coupling of the bracket 12 to the connecting member 16 and the drive arrangement between the linking member 18 is the same as is the case for bracket 14. For convenience only one will be described.

The screw drive 34 is formed of a cylinder 20 having a helical groove 26 extending around its periphery. A hole 36 extends through the cylinder 20. The bracket 12 is pivotally coupled to the connecting member 16 via an axle in the form of a shaft 30 which extends through the hole 36 and holes in side walls 28 of the connecting member 16. The axle shaft 30 is connected to the side walls 28, but cylinder 20 can rotate about axle shaft 30. In other embodiments the axle shaft 30 rotates in relation to the side walls 28 and is fixed in relation to the cylinder 20.

The linking member 18 includes collars 22 at either end. The collars 22 receive and circumferentially surround the cylinders 20. The collars 22 are shorter than the length of the cylinder 20. Inside each collar 22 is a inwardly projecting follower pin 26 that is received by the groove 24 of the screw drive 34. But for the follower pin 26 engaging with the groove 24 the linking member 18 would be free to slide from side to side of the connecting member 16 along the length of the cylinder 20. The follower pin 26 and helical groove 24 form a screw jack arrangement so that pivoting of the bracket 12 causes rotation of the screw drive 34, which in turn transversely drives the follower pin 26 and thus the linking member 18 in relation to the connecting member 16.

The direction of rotation or pitch of the groove 24 in the screw drive 34 is the same for each bracket 12 and 14 so that pivotal rotation of the bracket 12 causes corresponding pivotal rotation in the bracket 14 in the same pivotal direction and vice versa.

Figure 4:
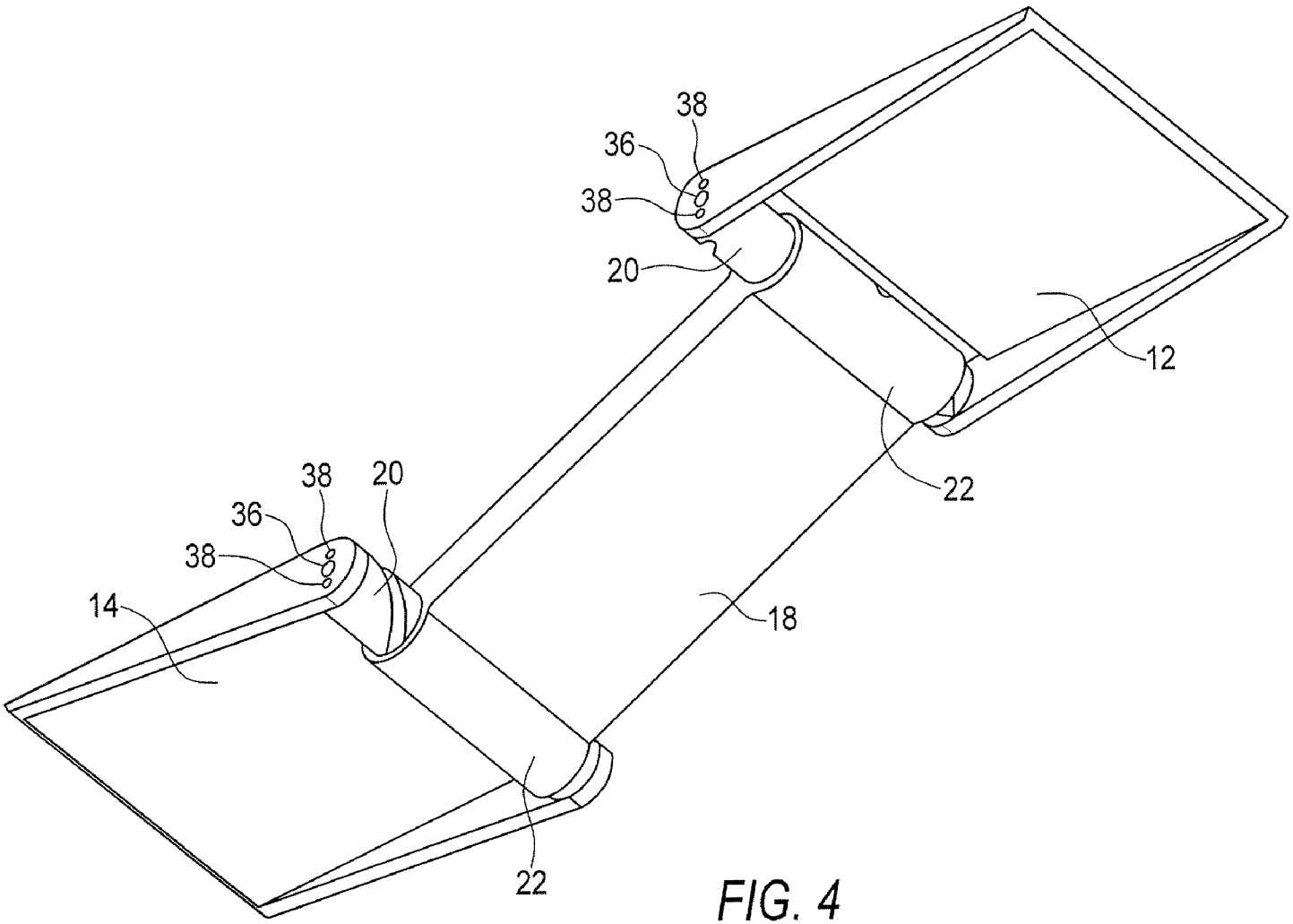
FIG. 4 is a lower perspective view of the adjustable support mechanism of FIG. 2 with a connecting member removed.

In FIG. 4, holes 38 are shown for securing the cylinders 20 to the planar members 32 of the brackets by the use of screws/bolts.

Figure 5:
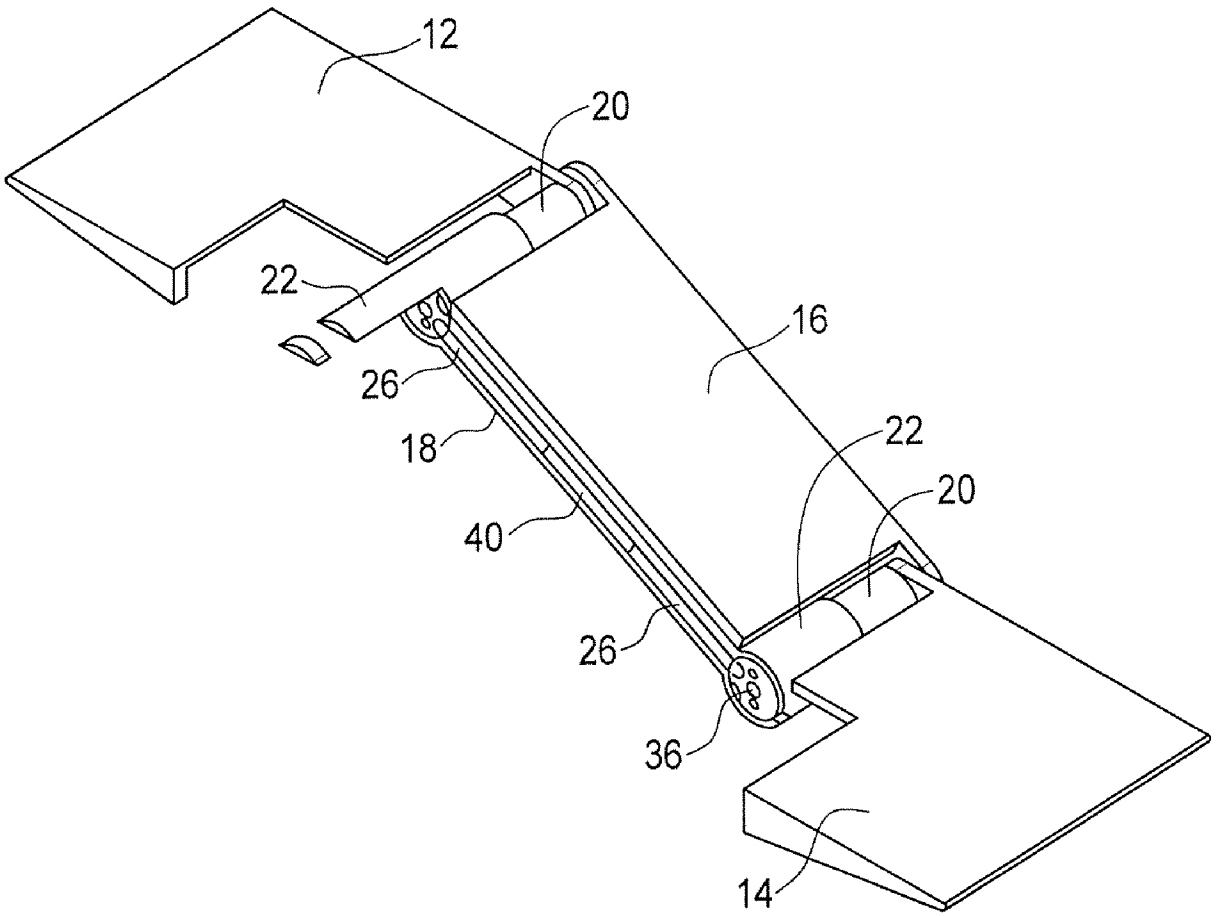
FIG. 5 is an upper perspective view with a partial cut away of the adjustable support mechanism of FIG. 2.

In FIG. 5 a gap 40 is shown between pins 26. A spring (not shown) may be positioned in the gap to urge the pins 26 apart and to ensure they engage their respective grooves 26.

Figure 6:
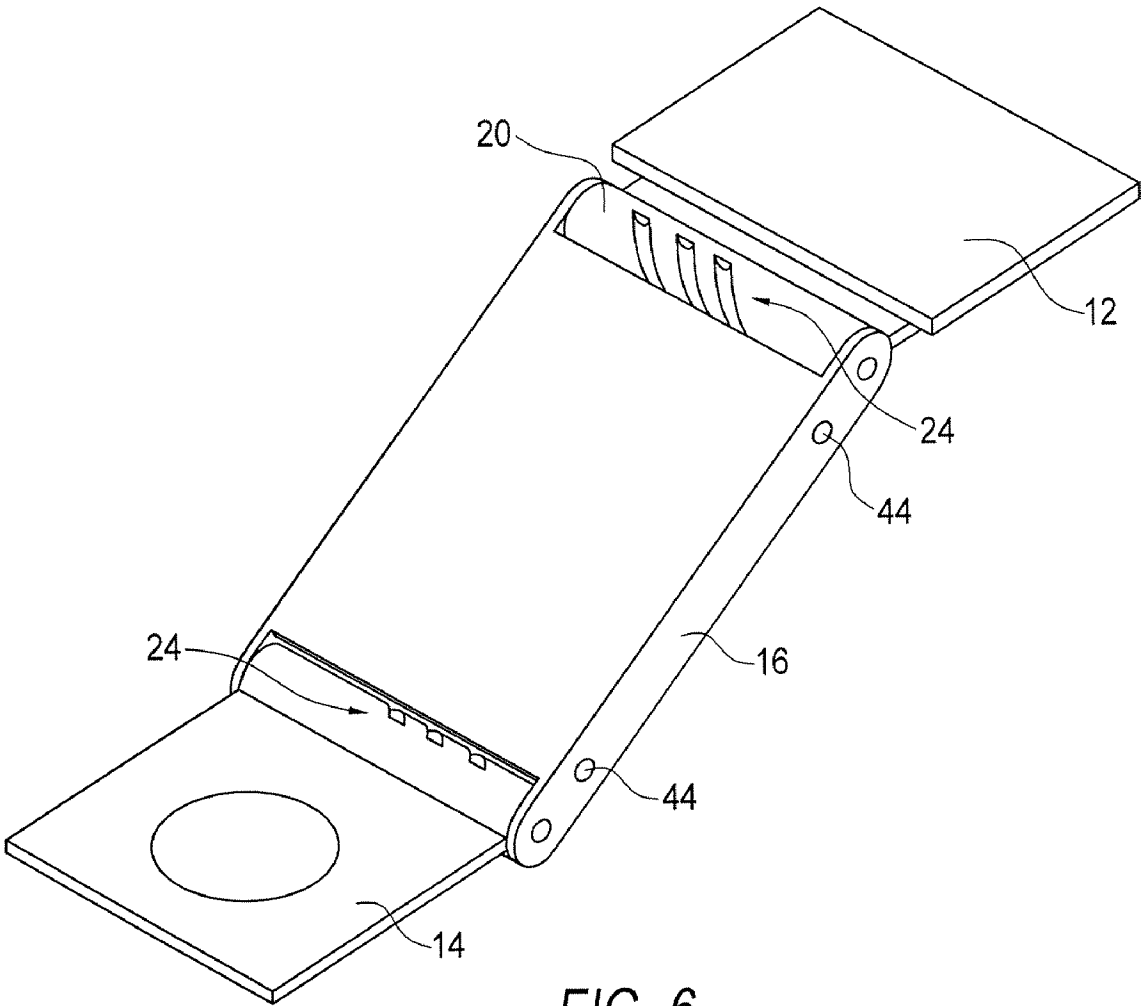
FIG. 6 is an upper perspective view of a second preferred embodiment of an adjustable support mechanism according to the present invention.
Figure 7:
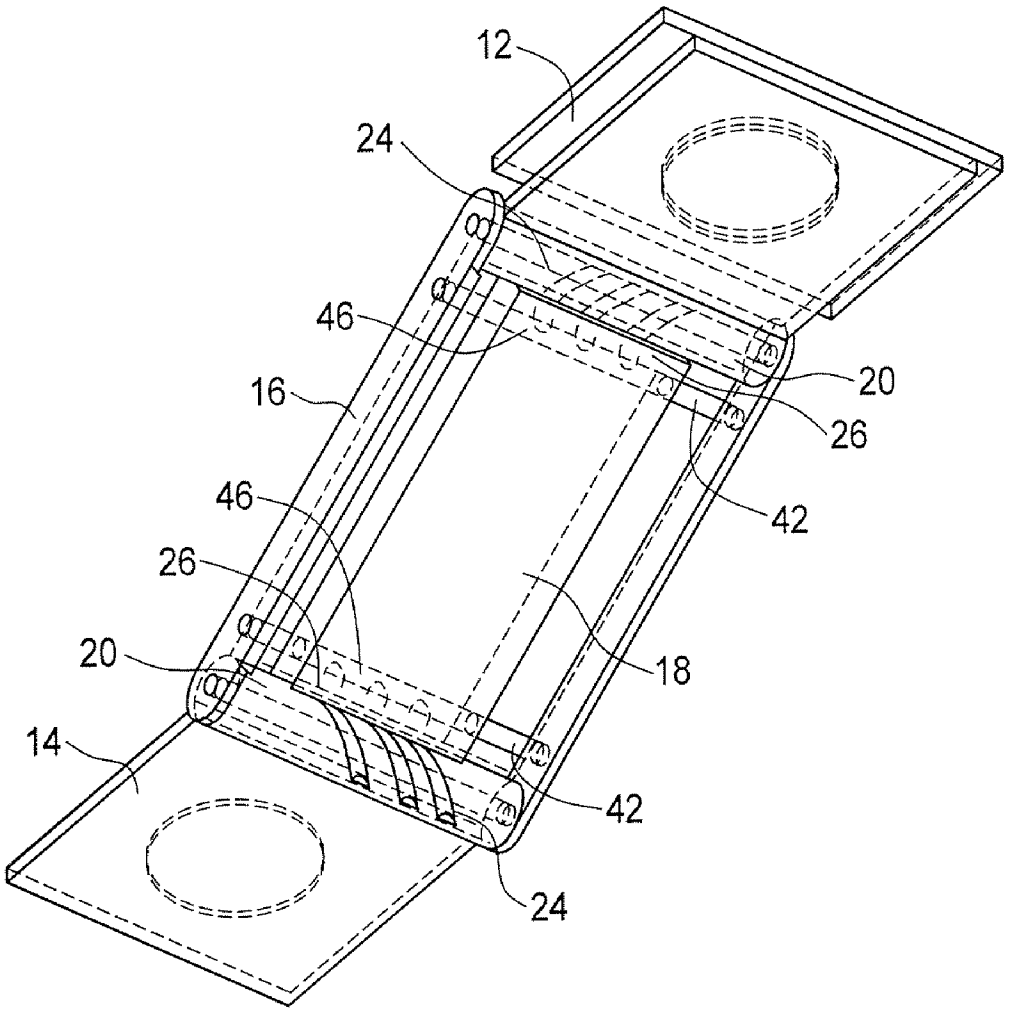
FIG. 7 is a lower perspective view of the adjustable support mechanism of FIG. 6.

Referring to FIGS. 6 and 7, this embodiment of the adjustable support mechanism 10 is similar to the previous embodiment although in this case there are some differences to the screw drive 34 and the linking 18, In this embodiment the screw drive 34 has a series of parallel, grooves 24 in the cylinder 20 that do not make a complete rotation of the screw drive 34. The linking member 18 has three follower pins 26 each of which project into a corresponding one of the three grooves 24 of the screw drive 34.

The linking member 18 has a hole 46 there through near each of the ends. A securing pin 42 passes through each hole 46 to couple the linking member 18 to the connecting member 16 in a manner which allows the linking member 18 to transversely slide along the securing pins 42 in relation to the connecting member 16. But for the follower pins 26 the linking member 18 would be free to slide along the length of the securing pins 42. The securing pins 42 pass though a corresponding hole 44 in the side walls of the connecting member 1.6 and are fixed to the connecting member 16.

Figure 8:
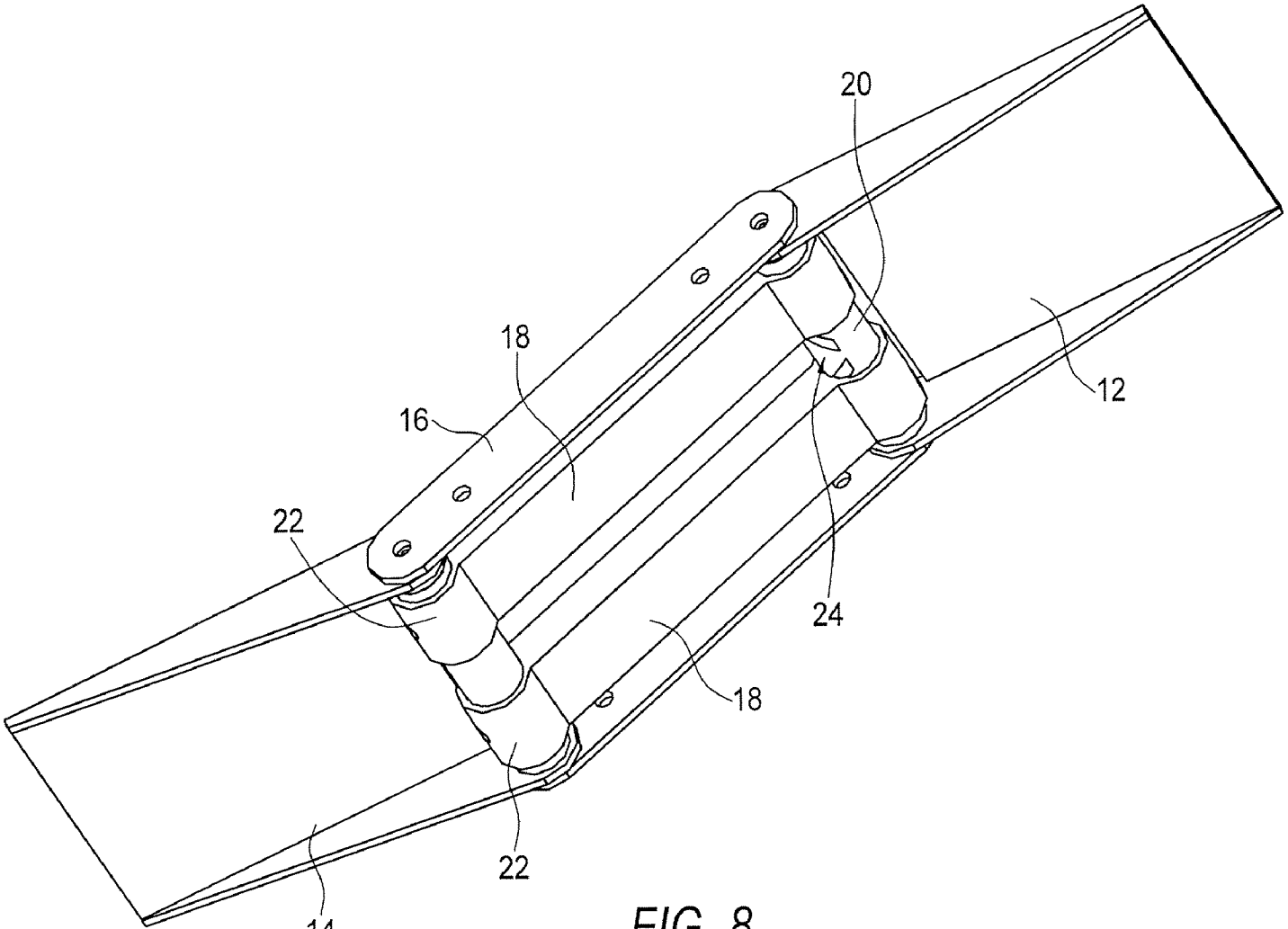
FIG. 8 is a lower perspective view of a third alternative embodiment of an adjustable support mechanism according to the present invention.
Figure 9:
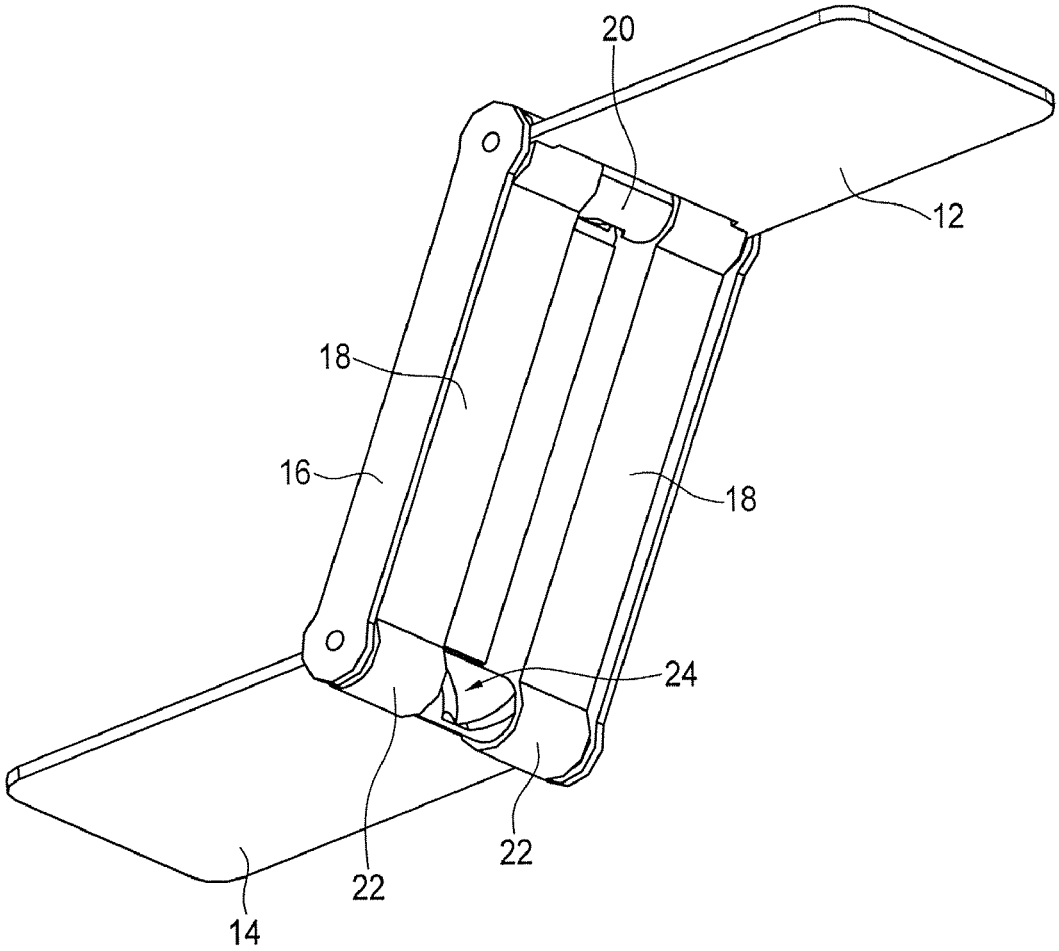
FIG. 9 is a lower perspective view of the adjustable support mechanism of FIG. 8 with brackets of the support mechanism in different positions relative to one another compared to the positions of the brackets in FIG. 8.

FIGS. 8 and 9 show a further alternative embodiment with two linking members 18. Each of the linking members 18 has a collar 22 at either end. A follower pin (not shown) projects inwardly from the collars 22 to engages with a corresponding helical groove 24 on the screw drive 20. It can be seen that the direction of rotation of the grooves 24 towards either end of the screw drive 34 are in opposite directions so that with rotation of the screw drive 34 the pair of linking members 18 either move towards one another or move apart from one another.

In FIG. 9 essentially the same adjustable support mechanism is shown with the relative position of the brackets 12 and 14 being different when compared to FIG. 8. The linking members 18 are their maximum distance apart. Providing two linking members 18 moving in opposite directions, neutralizes thrust created as the linking members 18 move.

Figure 10:
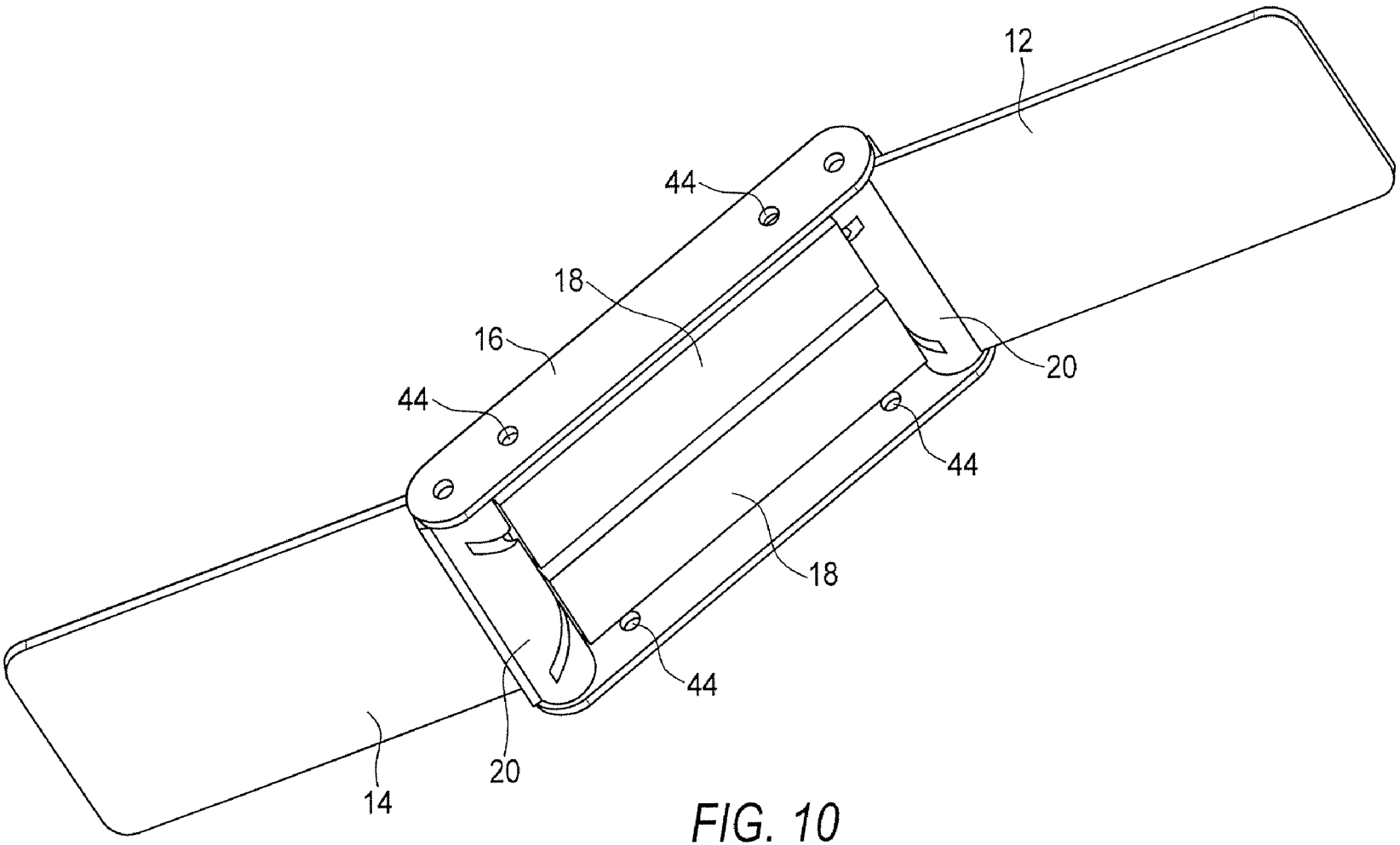
FIG. 10 is a fourth alternative embodiment of an adjustable support mechanism according to the present invention.

Referring to FIG. 10 a similar concept to that shown in FIGS. 8 and 9 is employed in this adjustable support mechanism. There are two linking members 18, but the linking members 18 are not coupled with collars 22, instead there are securing pins (not shown) similar to those used in the embodiment shown in FIG. 7. In case each linking member 18 has a hole (not shown) there through near either end through which the securing pins are positioned. Each linking member 18 has a follower pin at either end that engages with the corresponding groove 24 in the screw drives 34.

Figure 11:
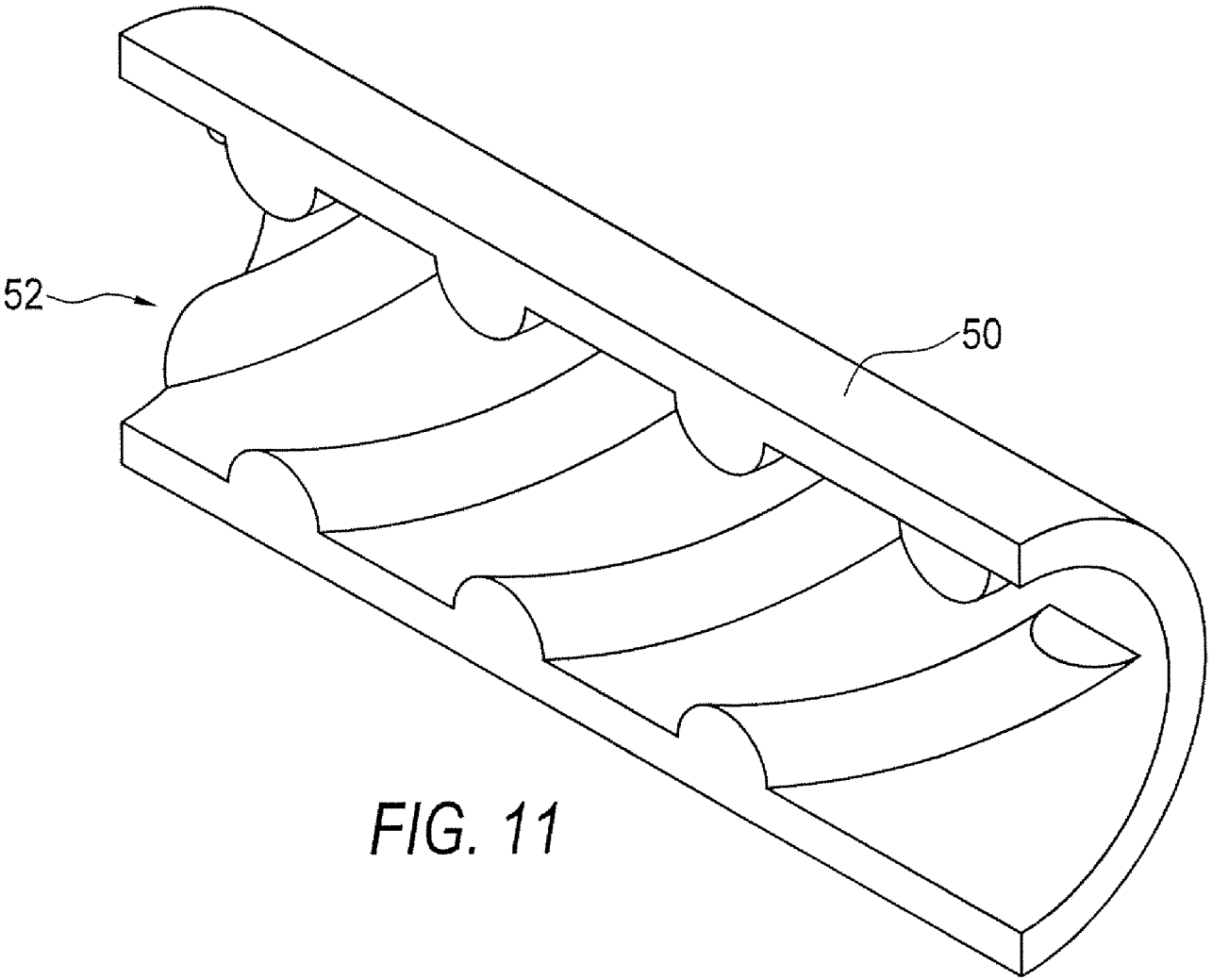
FIG. 11 is a perspective view of a half nut used in a further alternative embodiment of an adjustable support mechanism according to the present invention.
Figure 11A:
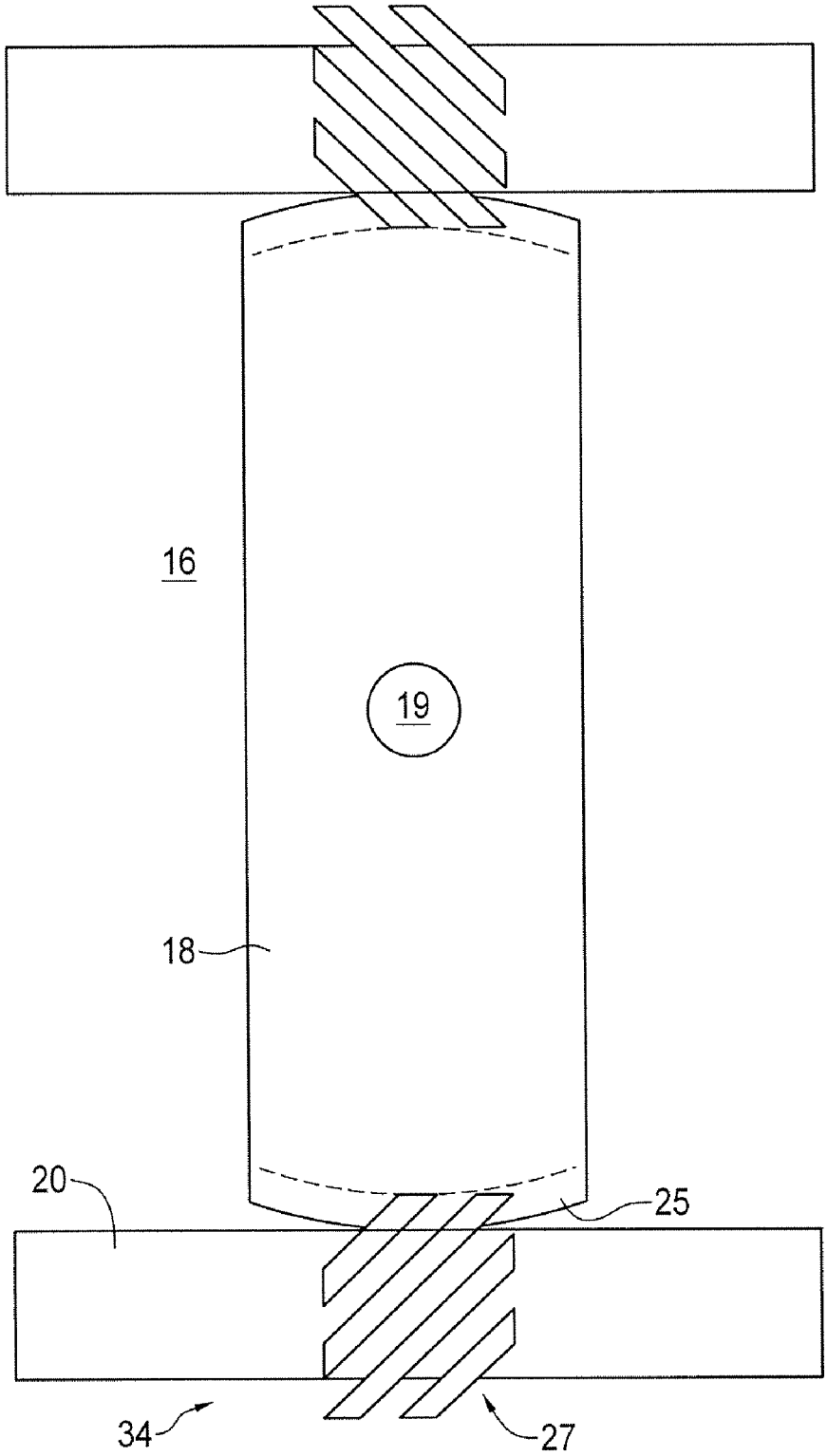
FIG. 11A is a bottom view of an alternative embodiment of a linking member and screw drive of an adjustable support mechanism according to the present invention.
Figure 11B:
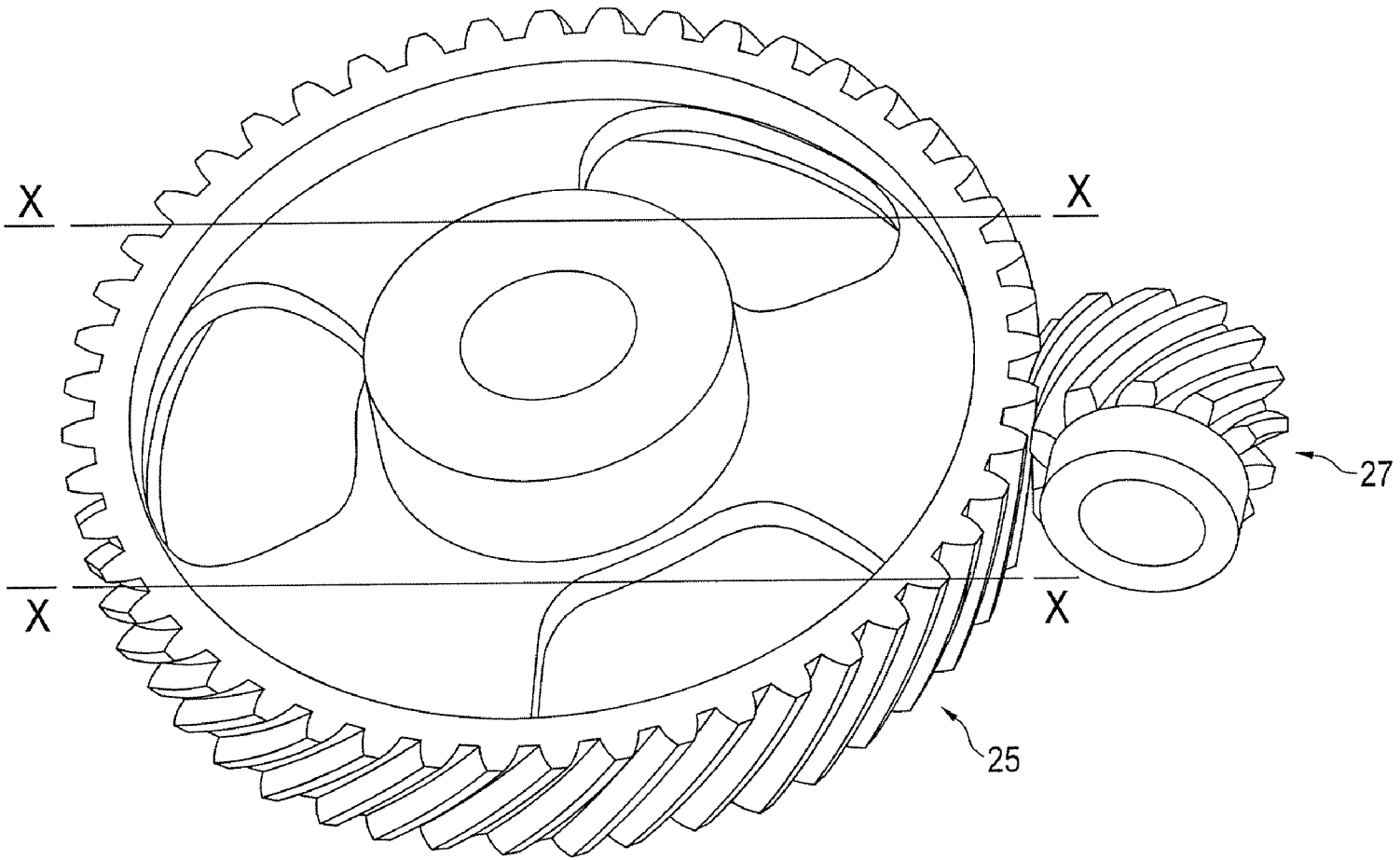
FIG. 11B is an example of a helical crossed gear.
Figure 11C:
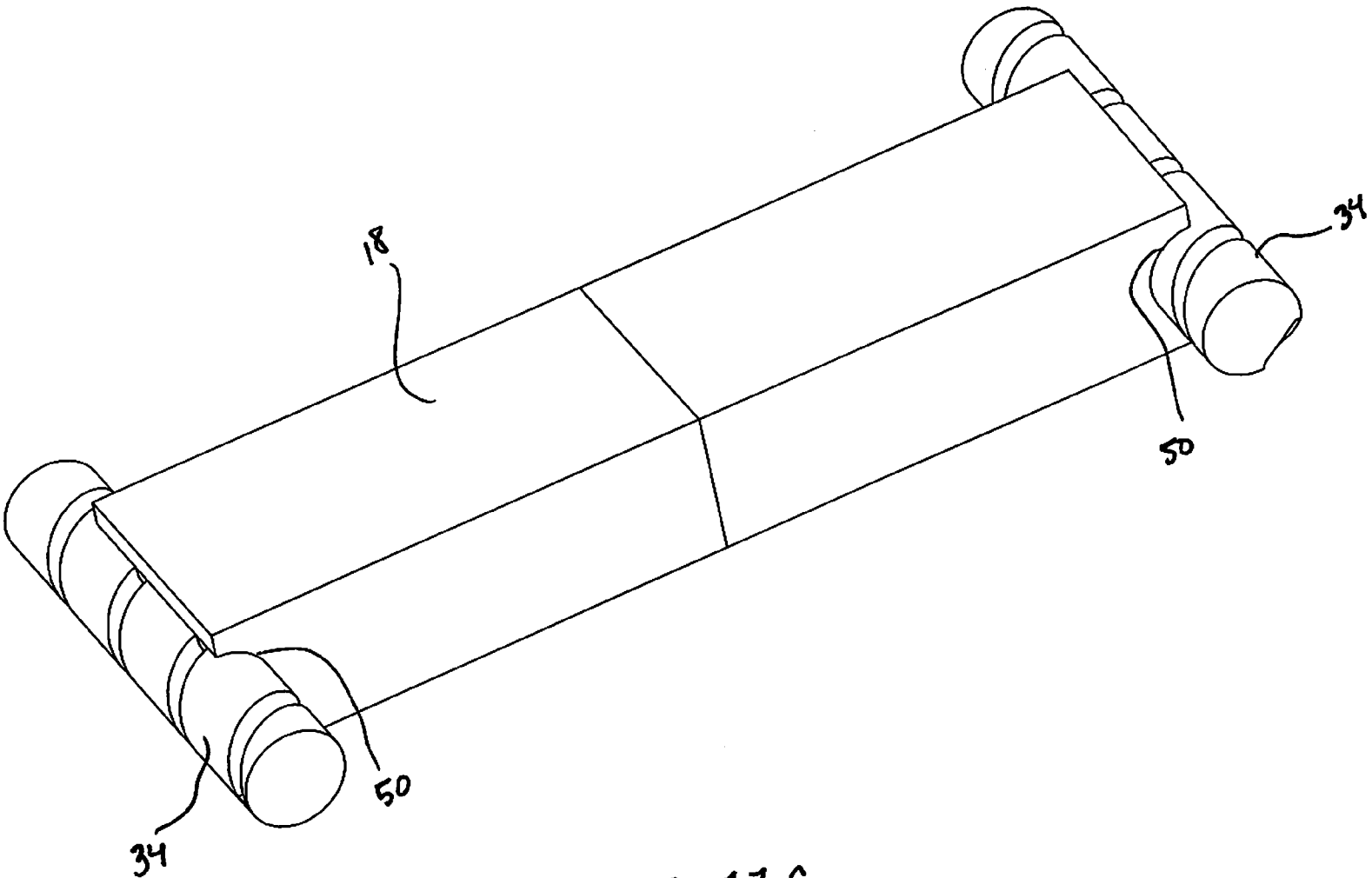
FIG. 11C is a perspective view of an embodiment of an adjustable support mechanism according to the present invention utilizing a half nut.
Figure 11D:
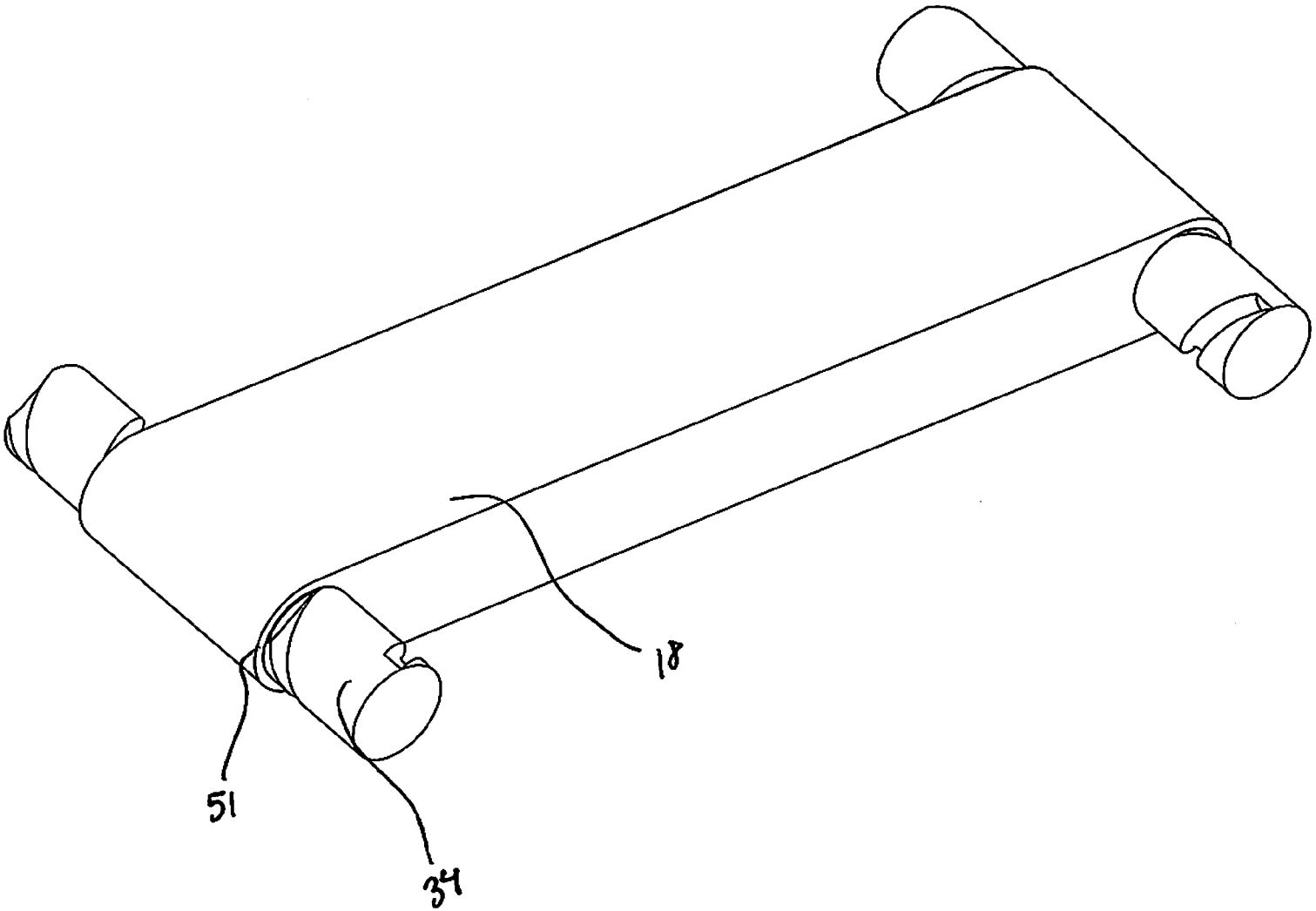
FIG. 11D is a perspective view of an embodiment of an adjustable support mechanism according to the present invention utilizing a full nut.
Figure 11E:
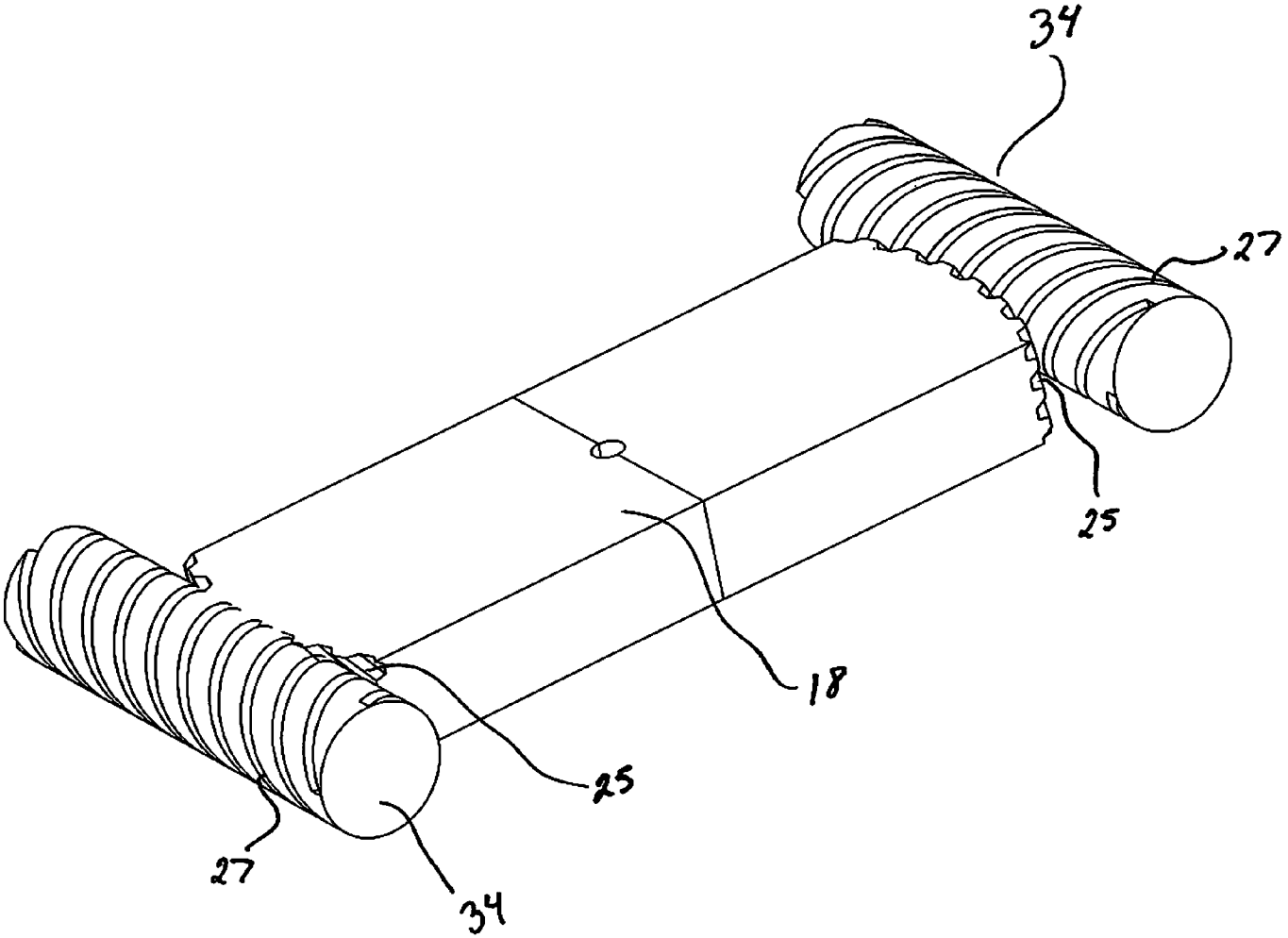
FIG. 11E is a perspective view of an embodiment of an adjustable support mechanism according to the present invention utilizing a helical mesh teeth arrangement

The collar and follower pin arrangement may be replaced with a half nut 50 as shown in FIG. 11 and FIG. 11C or a full nut 51 as shown in FIG. 11D. An inwardly projecting thread 52 on the inside of the half nut 50 or full nut 51 replaces the follower pin. The half nut or full nut arrangement is believed to be advantageous as loading is distributed along the inwardly projecting thread 52 rather than on a relatively small pin. It will also be appreciated that the screw drive may instead of having grooves have one or more threaded projections with the half nut having inner grooves rather than an inwardly projecting thread.

In FIG. 11A an alternative coupling arrangement between the screw drive 34 and linking member 18 is shown. In this embodiment linking member 18 pivots about axle 19 which extends from the back plate 68 of the connecting member 16. In this embodiment the screw drive 34 includes helical mesh teeth 27 and the follower is in the form of helical mesh teeth 25. The teeth 27 and 25 form a helical crossed gear. An example of a helical crossed gear is shown in FIGS. 11B & 11D. The linking member 18 may in effect be formed by removing the superfluous side portions above and below the lines indicated as X-X in FIG. 11B.

Figure 12:
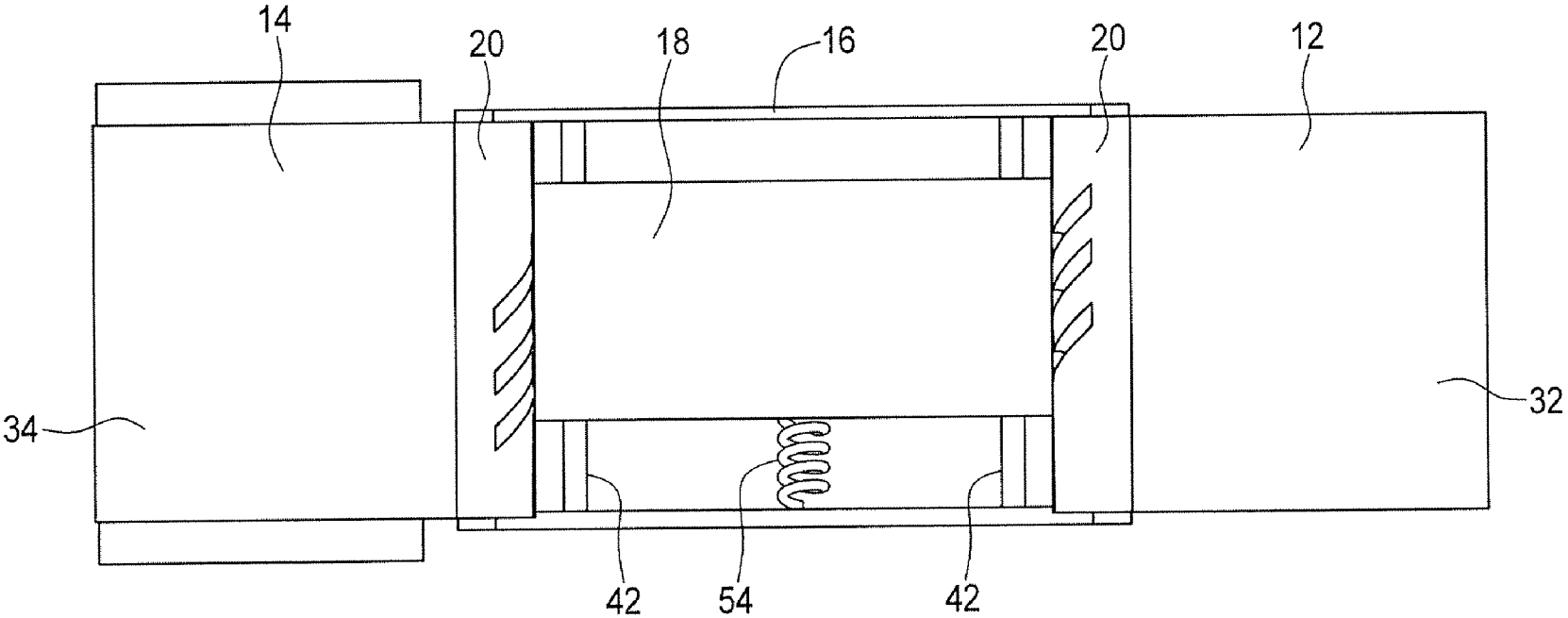
FIG. 12 is a bottom view of a variation of the preferred embodiment shown in FIGS. 6 and 7.

Referring to FIG. 12, a biasing means 54 in the form of a spring is shown. The spring 54 urges the linking member 18 to return to a rest position. This encourages the planar members 32 to remain in the same plane if the return position of the linking member 18 is in the centre of the connecting member 16, as shown. Movement of the linking member 18 in either direction due to pivotal movement of the brackets 12 and 14 with respect to the connecting member 16 will cause translation of the brackets 12 and 14 with respect to one another. Such movement must overcome the bias of the spring 54. when the moving force ends and subject to the adjustable support member not being locked in position, the biasing force will urge the linking member 18 to return to the rest position. The brackets 12 and 14. will also translate back to their rest positions relative to one another.

Figure 13:
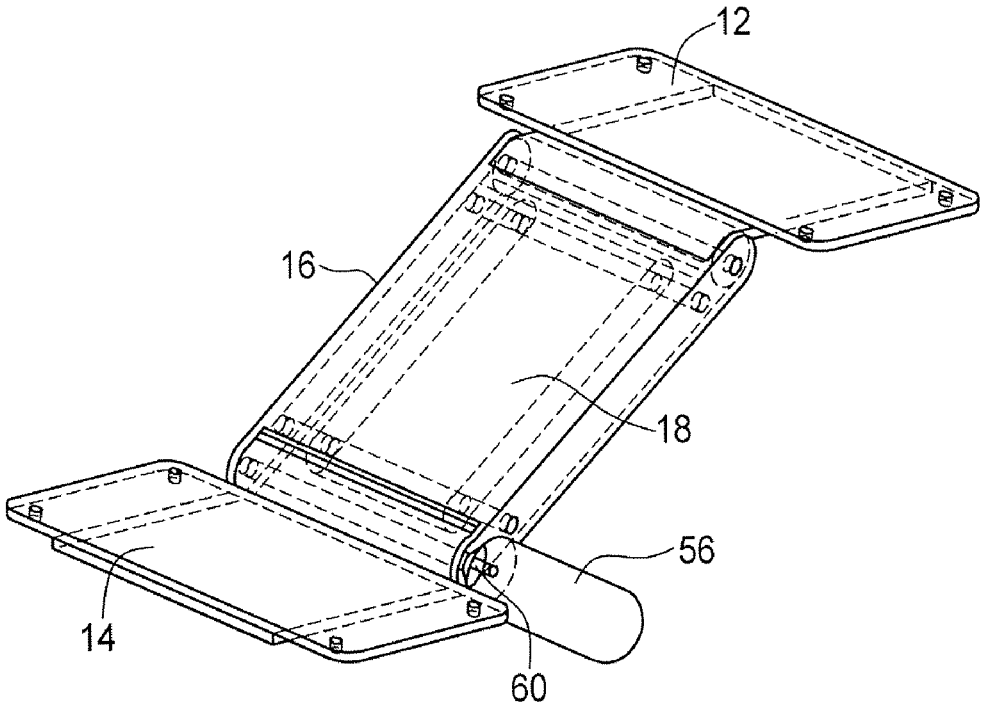
FIG. 13 is an upper perspective view of an adjustable support mechanism with a locking means.
Figure 2:
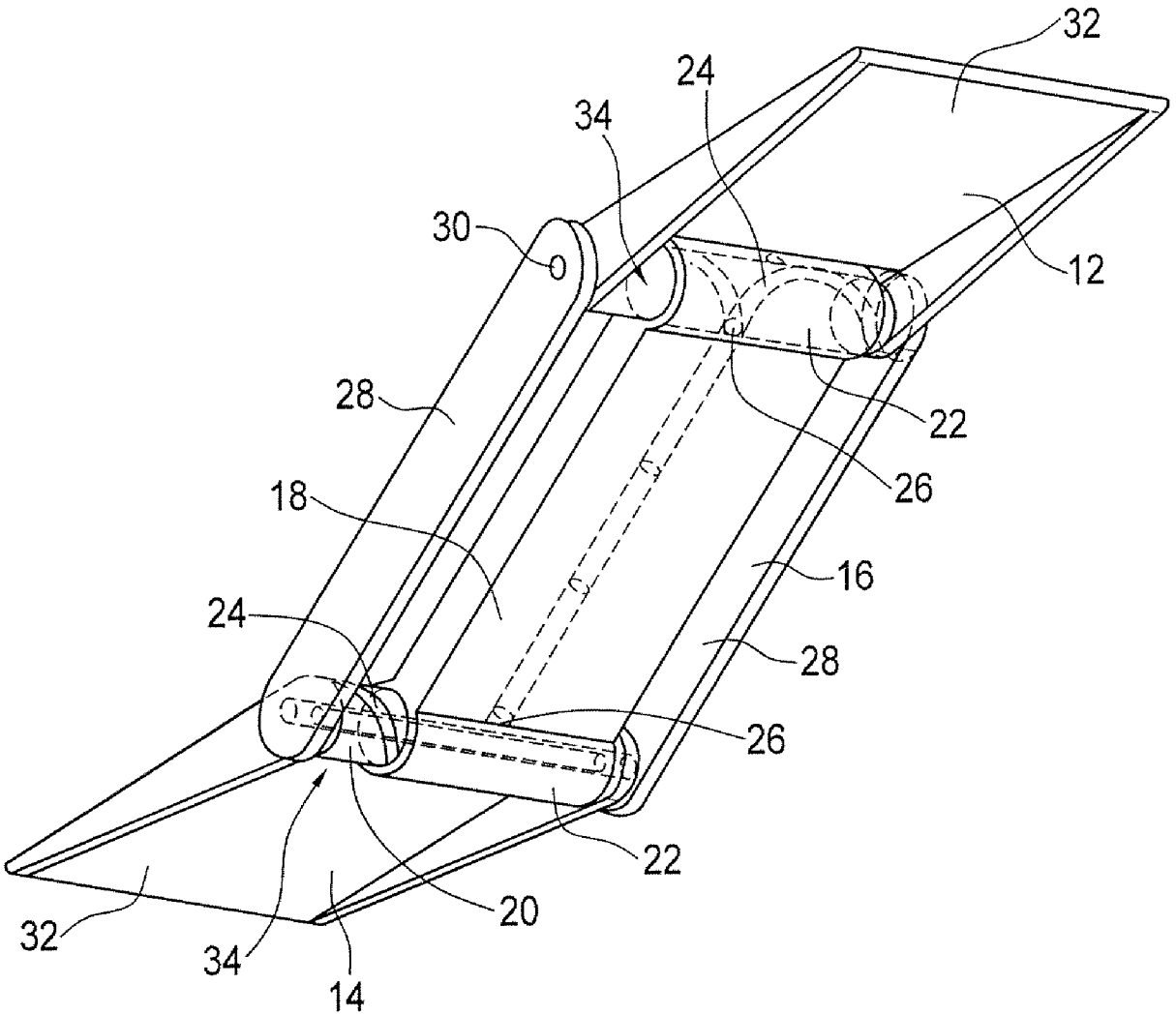
FIG. 2 is a lower perspective view of a first alternative embodiment of an adjustment support mechanism according to the present invention.
Figure 3:
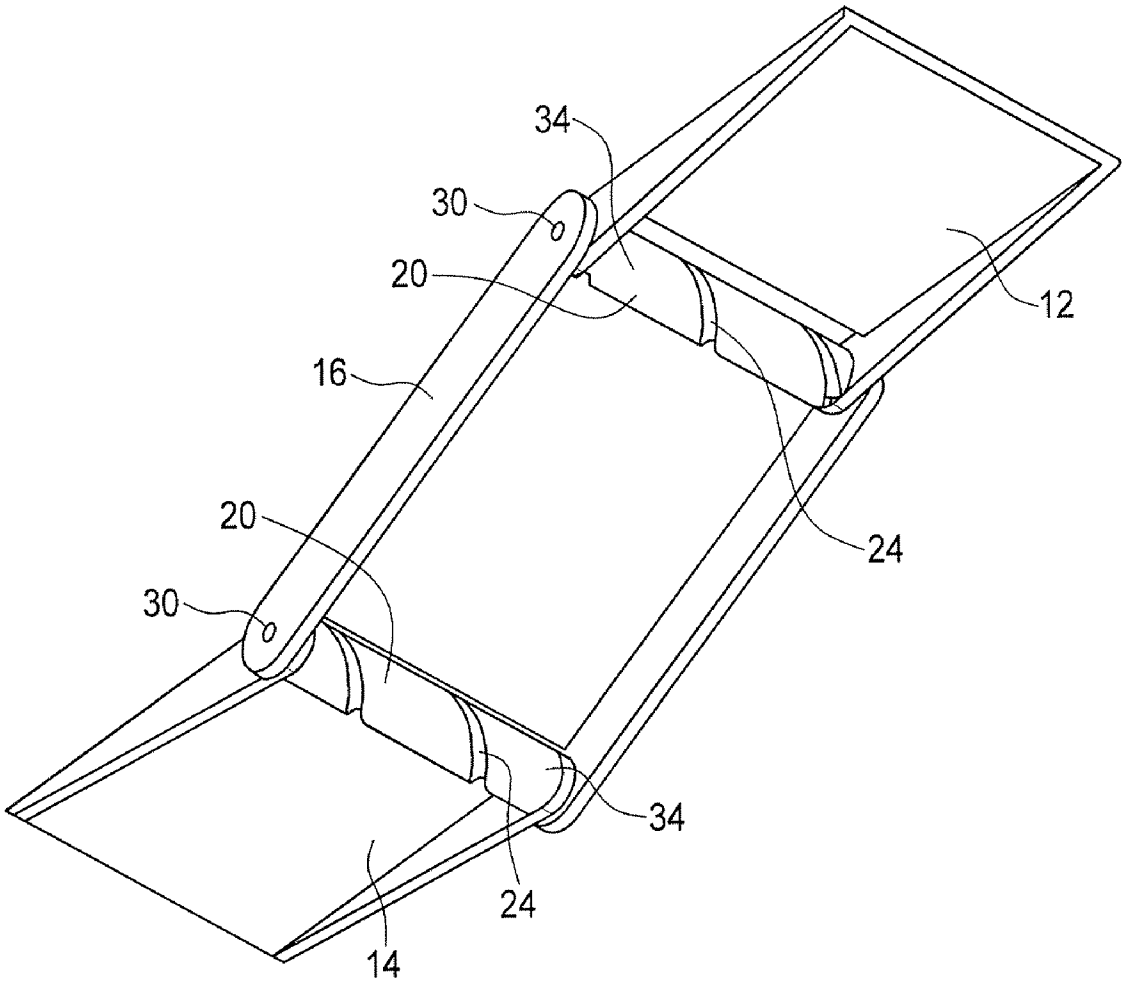
FIG. 3 is a lower perspective view of the adjust support mechanism of FIG. 2 with a linking member removed.
Figure 13A:
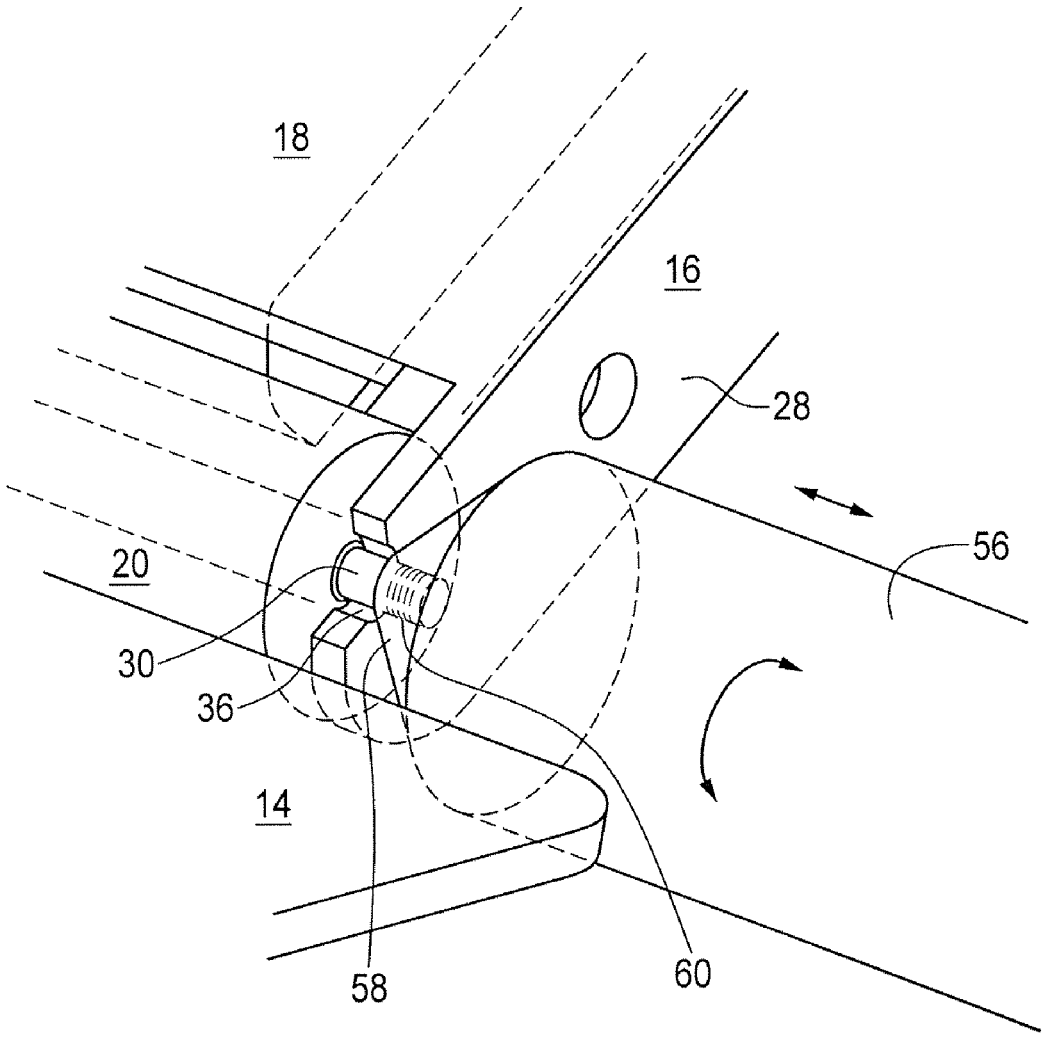
FIG. 13A is an enlarged upper perspective view the locking means of FIG. 13 shown including a cut away portion of the side wall of the connecting member.

In FIGS. 13 and 13A the adjustable support mechanism 10 includes a locking mechanism. In this embodiment axle shaft 30 is fixed to the cylinder 20 and able to rotate within the hole 36. The locking mechanism includes a threaded end 60 of shaft 30 and a knob 56 on the outside of the connecting member 16. The knob 56 includes a jam 58 on an inner face adjacent to the side wall 28 of the connecting member 16. The shaft 60 in threadingly connected to the knob 56 so that when the knob 56 is rotated the jam 58 moves towards or away from the sidewall 28. When the jam 58 moves far enough towards the side wall 28 it will contact the side wall 28 and prevent the shaft 30 from rotating with respect to the connecting member 16 thus locking the adjustable support mechanism in position. Alternatively the knob 56 may be fixed to the cylinder 20 via the shaft 30 (without the thread) and may be rotatable about its length with respect to the connecting member 16, so that it can be use to assist in pivoting the cylinder 20 in relation to the connecting member 16, thereby making adjustment of the support easier.

Figure 14:
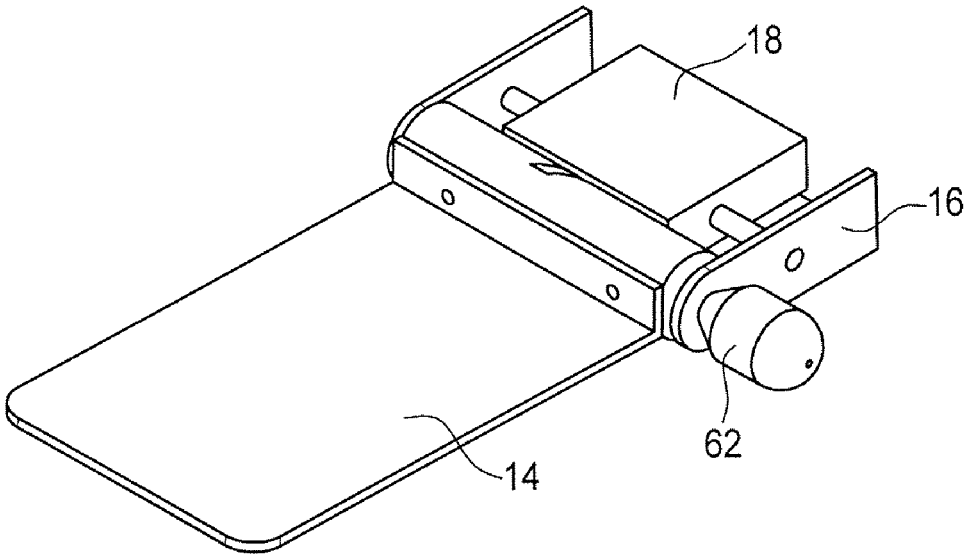
FIG. 14 is a partial lower perspective view of a part the preferred embodiment shown in FIG. 6 with an angle adjustment means and with a bracket shown parallel with a connecting member of the adjustable support mechanism.
Figure 15:
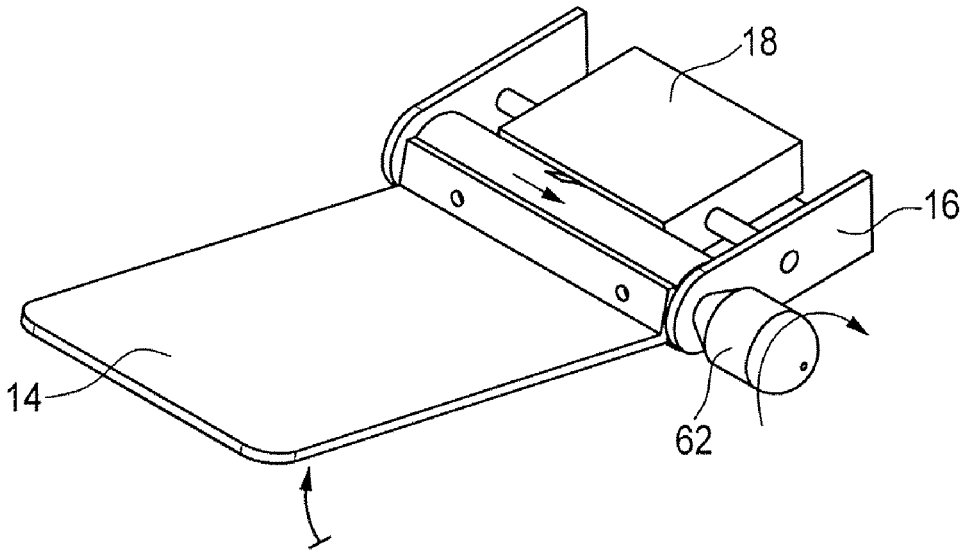
FIG. 15 is a partial lower perspective view showing the same portion of the adjustable support mechanism shown in FIG. 14 with the angle adjustment means having changed the angle of the bracket relative to the connecting member.
Figure 16:
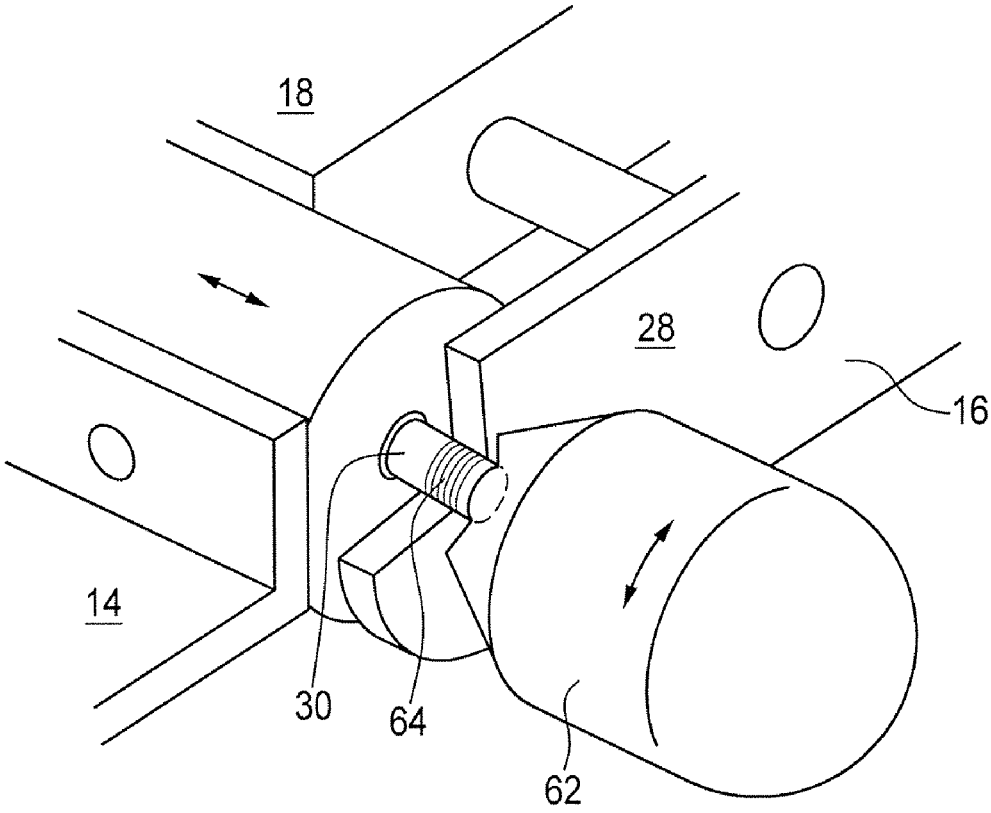
FIG. 16 is an enlarged partial lower perspective view 5 with a cutaway portion with the adjustable support mechanism of FIG. 14.
Figure 17:
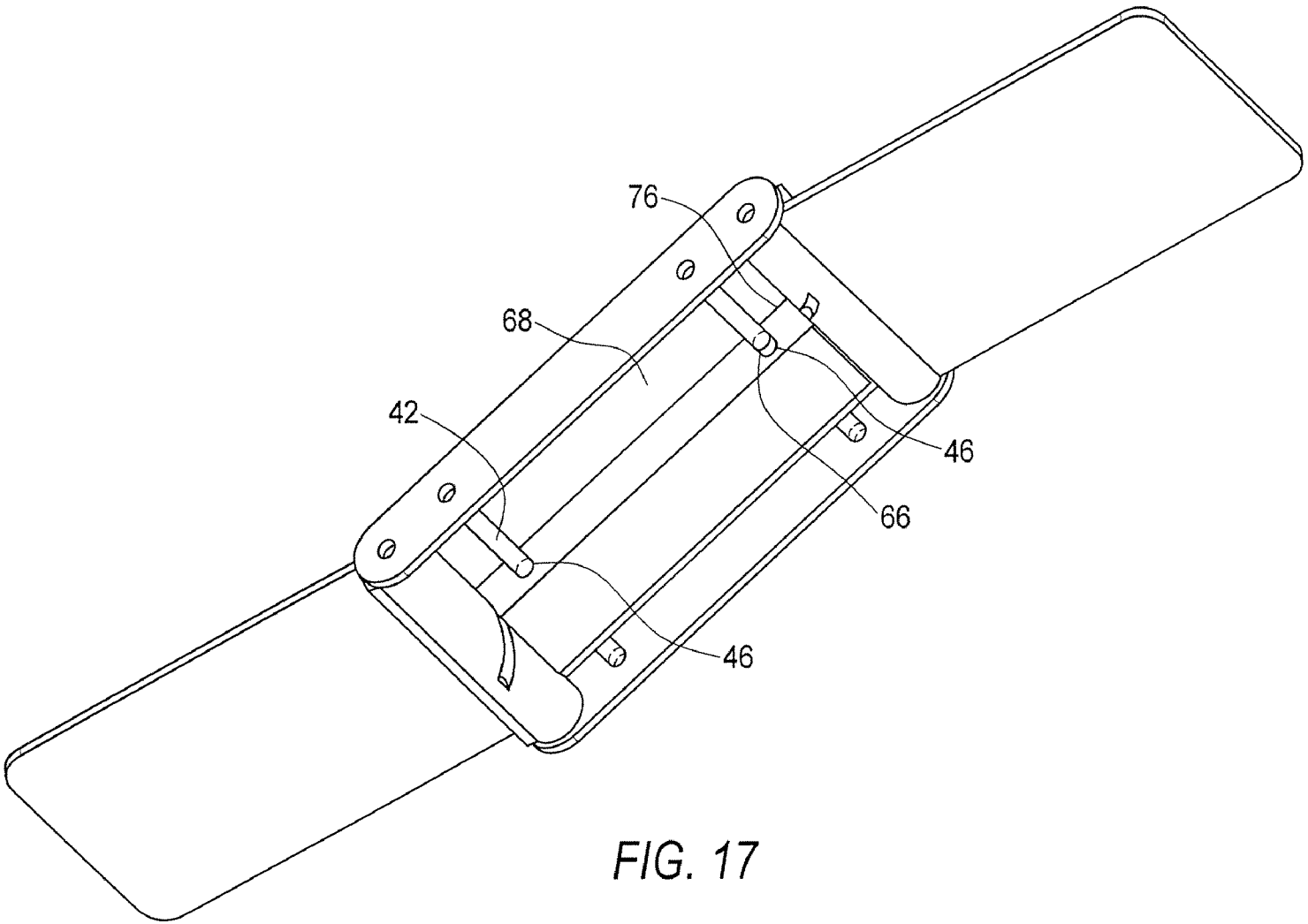
FIG. 17 is a lower perspective view of a further alternative embodiment of the adjustable support mechanism in accordance with the present invention including a locking means.
Figure 18:
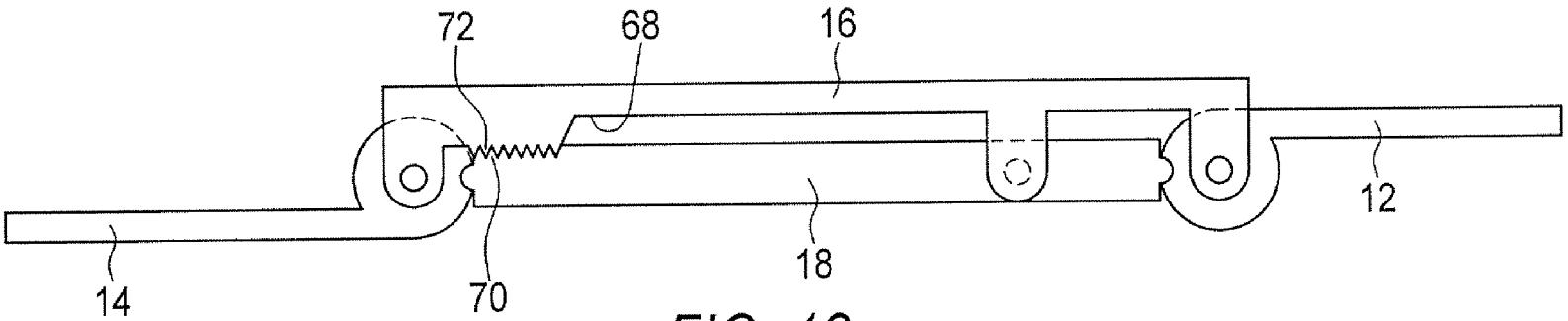
FIG. 18 is a partial cutaway side elevation of the embodiment shown in FIG. 17 with the locking means engaged.
Figure 19:
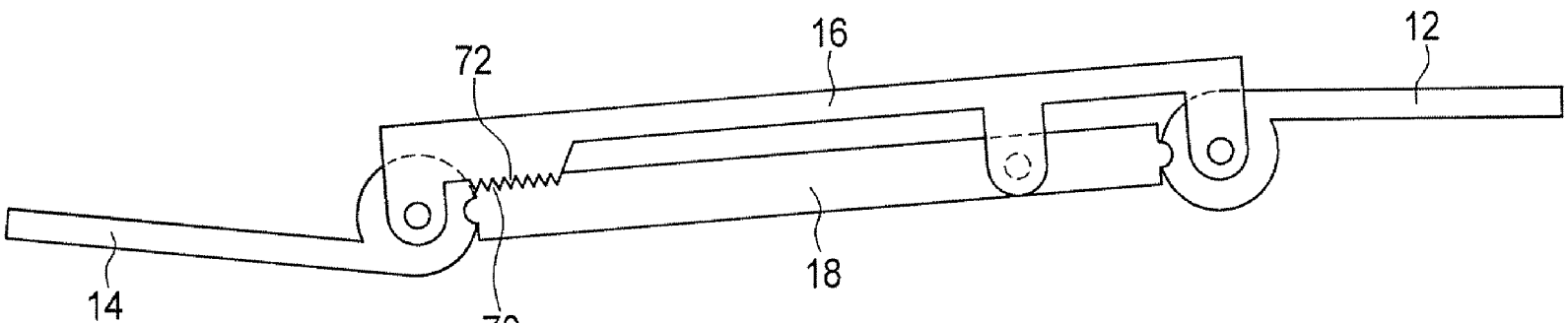
FIG. 19 is a partial cutaway side elevation of the embodiment shown in FIG. 17 with the locking means disengaged.

FIGS. 14, 14A and 15 show an angle adjustment mechanism comprising a shaft 30 fixed to a knob 62 on the outside of the connecting member 16. The shaft 30 is threadingly coupled to the side wall 28 of connecting member 16. The shaft 30 is also engaged with the cylinder 20 so that transverse movement of the shaft 30 causes transverse movement of the cylinder 20, but rotation of the cylinder 20 does not cause rotation of the shaft 30 and vice versa. When the knob 62 is rotated it moves through the thread in the side wall 28 which causes the shaft 30 and therefore the cylinder 20 to move transversely relative to the connecting member 16. The cylinder 20 may be transversely movable in relation to the connecting member 16 and planar member 32 of the bracket 14. The cylinder 20 must be shorter than the width of the connecting member 16, The cylinder 20 may be orbitally coupled to the planar member 32 of the bracket 14 so that the planar member 32 moves in an orbiting manner about the centre of rotation of the cylinder 20 with rotation of the cylinder 20. Due to the screw jack arrangement with the linking member 18 transverse movement of the cylinder causes the screw drive 34 to rotate with respect to the connecting member 16 thereby adjusting the angle of the planar member 32 of the bracket relative to the connecting member 16. An alternative locking means is shown in FIGS. 17 to 19. One hole 66 of the holes 46 in the linking member 18 (through which one of the securing pins 42 passes) is slotted to allow the linking member 18 to move slightly towards or away from a backing plate 68 of the connecting member 16. The linking member 18 includes a corrugated region 70 adjacent a corresponding corrugated region 72 of the backing plate 68.

By allowing the linking member 18 to move slightly away from the connecting member 16 the corrugated regions do not engage. However, when the linking member 18 moves towards the connecting member 16 the corrugated regions engage thus causing interference there between which prevents transverse movement of the linking member 18 with respect to the connecting member 16. This is turn acts as a lock to the adjustable member 16. This in turn acts as a lock to the adjustable support mechanism. It can be seen in FIG. 19 that by slightly tilting the bracket 14 in relating the connecting member 16 the linking member 18 drops slightly and moves away from the connecting member 16.

It is preferred that the manner of moving the linking member 18 towards the connecting member 16 is by pivoting the bracket 14 in a direction naturally inclined to be taken under the influence of gravity. Thus the weight of the bracket 14, by leverage under gravity, locks the adjustable support mechanism. If the weight of the bracket is insufficient it may include a weight on the underside away from the connecting member 16 so that the sufficient force is applied to lock the support mechanism.

A further locking mechanism can be achieved by use of friction between the follower and the screw drive. Yet a further locking mechanism may be as follows. Under the weight of the support mechanism and its load, gravity will act as a bias which would tend to rotate the second bracket 14 orbitally in relation to the first bracket when the first bracket is positioned horizontally and fixed to a stationary object. This will tend to cause the second bracket 14 to pivot in the opposite direction that the first bracket 12 is inclined to pivot under drive via the linking member 18. Thus the adjustable support mechanism may be locked under its own, weight.

Figure 20:
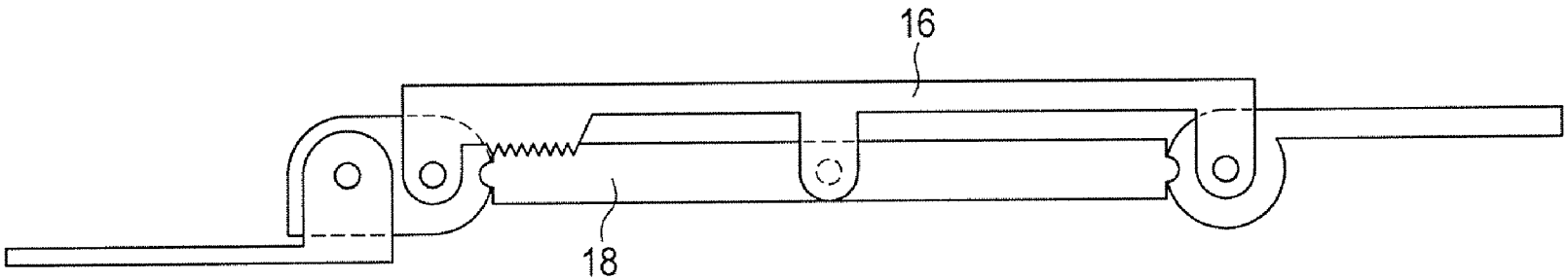
FIG. 20 is a partial cutaway side elevation of a further embodiment of the adjustable support mechanism with an alternative angle adjustment means to that shown in FIG. 14 with the bracket in the first position.
Figure 21:
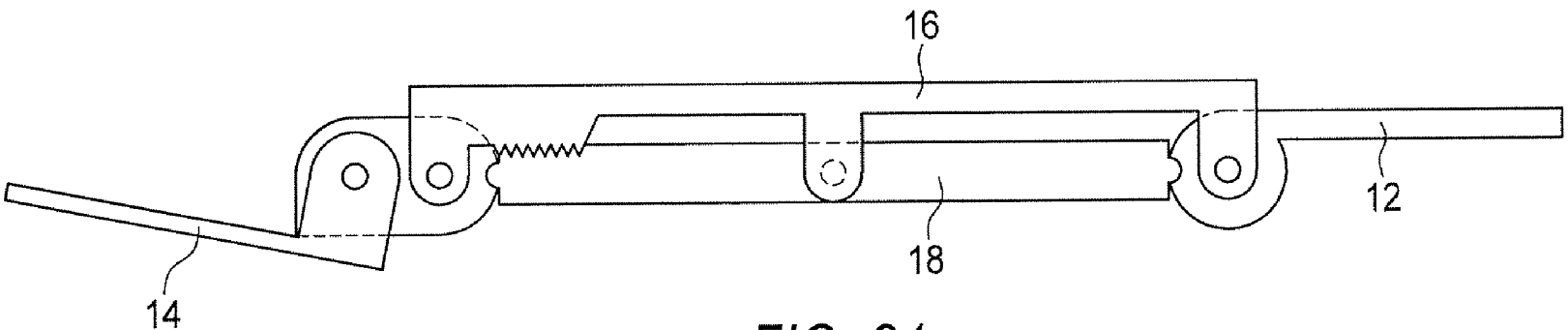
FIG. 21 is a partial cutaway side elevation of the embodiment shown in FIG. 20 with the adjustment means adjusting the angle of the bracket to the second position.

A further angle adjustment means is shown in FIGS. 20 and 21 where the bracket includes a second pivotal connection 74 between the cylinder 20 and the planar member 76. The second pivotal connection 74 is formed on a relatively short spacing member 78 which spaces the second pivotal connection 74 from the pivotal connection formed between the cylinder 20 and the connecting member 16.

The method of use and operation of the present invention will now be described with reference to the accompanying drawings.

The support bracket of the present invention has Particular application supporting a computer keyboard support platform relative to a bench or desk. It will be appreciated that numerous other applications can be found for the support mechanism but the computer desk support will be described for convenience. The first bracket is coupled to the desk generally by screwing it in the underside of the desk so that the planar member is horizontal. The keyboard support platform is coupled to the planar member of the second bracket. By raising and lowering the keyboard support platform relative to the desk in a parallel manner the height of the keyboard support platform may be adjusted. A considerable range of up and down movement can be provided by the support mechanism. It also provides advantage over the prior art that there are not parallelogram links and the present invention is relatively slim line. In addition there are no pinch points that are often involved in link arm and in particular parallelogram link arm arrangements.

The position of the keyboard support platform may be maintained by locking the adjustable support mechanism as described above. Furthermore the angle of the keyboard support platform relative to the desk may be adjusted by using the angle adjustment mechanism as described above.

A skilled addressee will realize that the present invention has advantages over the prior art. In addition to the advantages mentioned above, in comparison to the some prior art support mechanisms, a support mechanism according to the present invention allows a greater range of movement of the second bracket relative to the first bracket.

A person skilled in the art will realize that modifications and variations may be made to the present invention without departing from the basic inventive concept. Some of the modifications and variations have been described herein, although it will be appreciated that other variations may be made which include further alternatives to the locking mechanism, the arrangement of the linking member in relation to the connecting member as well as variations to the angle adjustment means.

Such modifications and variations are intended to all within the scope of the present invention, the nature of which is to be determined from the foregoing description and appended claims.

What is claimed is:

1. An adjustable support mechanism for supporting a computer keyboard, comprising:

a first bracket comprising a first screw drive, said first screw drive defining a cylinder with a periphery;

a second bracket comprising a second screw drive, said second screw drive defining a cylinder with a periphery;

a connecting member pivotally coupled to the first bracket at a first position and pivotally coupled to the second bracket at a second position spaced from the first position; and a linking member having a first end and a second end, the first end of the linking member engaging the first screw drive, the second end of the linking member engaging the second screw drive, wherein rotation of the first bracket in a first rotational direction drives the linking member to move in a transverse direction relative to the connecting member, wherein the linking member's movement in said transverse direction drives the second bracket to rotate in the first rotational direction.

2. The support mechanism according to claim 1, wherein the linking member's first and second ends comprise collars formed thereon, wherein said collars engage said first screw drive and said second screw drive by receiving and circumferentially surrounding said cylinders.

3. The support mechanism according to claim 2, wherein said cylinders comprise a helical groove extending around said periphery.

4. The support mechanism according to claim 3, wherein said collars further comprise an inwardly projecting follower pin that is received by the groove in the cylinder of said first and second screw drives.

5. The support mechanism according to claim 4, wherein the groove in the cylinder of said first and second screw drives has a direction of rotation that is the same for each of said first and second screw drives such that pivotal rotation of one of said first or second brackets causes corresponding pivotal rotation in the other of said first or second brackets.

6. The support mechanism according to claim 4, wherein the groove in the cylinder of said first and second screw drives has a pitch that is the same for each of said first and second screw drives such that pivotal rotation of one of said first or second brackets causes corresponding pivotal rotation in the other of said first or second brackets.

7. The support mechanism according to claim 1, wherein said cylinders each comprises a plurality of parallel grooves, each of said grooves making less than a complete rotation around said periphery, and wherein said linking member's first and second ends each comprise a plurality of follower pins, each of which project into corresponding one of said parallel grooves.

8. The support mechanism according to claim 1, wherein the periphery of said cylinders each comprises one or more grooves, and wherein said linking member's first and second ends each comprise a half nut or full nut attached thereto, said half nut or full nut having an inwardly projecting thread on an inside surface thereof for engaging said one or more grooves.

9. The support mechanism according to claim 1, wherein the periphery of said cylinders each comprises a helical mesh teeth arrangement, said linking member is pivotally connected to said connecting member, and wherein said linking member's first and second ends each comprise a helical mesh teeth arrangement for engaging the helical mesh teeth arrangement formed in the periphery of said cylinders, thereby forming a helical crossed gear arrangement.

10. The support mechanism according to claim 1, wherein said mechanism comprises two linking members, each of said linking members having a first end and a second end, said ends having collars formed thereon engaging said first screw drive and said second screw drive by receiving and circumferentially surrounding said cylinders.

11. The support mechanism according to claim 10, wherein said cylinders each comprise a helical groove extending around said periphery, and wherein said helical groove has directions of rotation toward either end of said first and second screw drives that are opposite in direction such that rotation of either the first or second screw drive in one direction causes said linking members to move toward one another and rotation of either the first or second screw drive in an opposite direction causes said linking members to move apart from one another.

12. The support mechanism according to claim 1, further comprising biasing means for biasing said linking member to a rest position.

13. The support mechanism according to claim 1, further comprising a locking mechanism.

14. The support mechanism according to claim 13, wherein said locking mechanism is engaged by a weight on one of said first bracket and said second bracket.

15. The support mechanism according to claim 1, wherein said first bracket and said second bracket are each coupled to said connecting member with a locking mechanism comprising a cylinder having a shaft extending therethrough and further extending through a sidewall of said connecting member, and wherein said locking mechanism comprises a knob with a jam on an inner face thereof, said knob being threadingly connected to said shaft such that when the knob is rotated in one direction, said jam contacts the sidewall of said connecting member, thereby preventing rotation of said bracket.

16. The support mechanism according to claim 1, wherein the linking member is coupled to the connecting member so as to be movable transversely in relation to the connecting member.

17. The support mechanism according to claim 1, further comprising a locking means for preventing transverse movement of the linking member with respect to connecting member.

18. The support mechanism according to claim 1, further comprising an angle adjusting means for adjusting the bracket.

19. An adjustable support mechanism for a computer keyboard, comprising:

a first bracket having a screw drive;

a second bracket having a screw drive;

a connecting member having a first end and a second end, the first end of the connecting member pivotally engaging the first bracket, the second end of the connecting member pivotally engaging the second bracket; and a linking member having a first end and a second end, the first end of the linking member coupling the screw drive of the first bracket, the second end of the linking member coupling the screw drive of the second bracket, such that rotation of the first bracket drives the first and second ends of the linking member to move in a transverse direction relative to the connecting member, such that the transverse movement of the second end of the linking member drives the second bracket to rotate.

* * * * *

UNITED STATES PATENT AND TRADEMARK OFFICE

CERTIFICATE OF CORRECTION

PATENT NO. : 7,717,383 B2
APPLICATION NO. : 10/580612
DATED : May 18, 2010
INVENTOR(S) : Edwin Robin Russell It is certified that error appears in the above-identified patent and that said Letters Patent is hereby corrected as shown below:

Title Page, Item [73], Please insert in Assignee:

--Humanscale Corporation, New York, NY--

Signed and Sealed this
Fifteenth Day of February, 2011

David J. Kappos

David J. Kappos
*Director of the United States Patent and Trademark Office*